US008565655B2

(12) United States Patent
Shida

(10) Patent No.: US 8,565,655 B2
(45) Date of Patent: Oct. 22, 2013

(54) IMAGE FORMING APPARATUS WITH BELT MEMBER PUSH-UP FEATURE

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 13/109,125

(22) Filed: May 17, 2011

(65) Prior Publication Data

US 2011/0293337 A1 Dec. 1, 2011

(30) Foreign Application Priority Data

May 31, 2010 (JP) ..... 2010-125241

(51) Int. Cl.
*G03G 15/16* (2006.01)

(52) U.S. Cl.
USPC ..... 399/313

(58) Field of Classification Search
USPC ..... 399/302, 303, 312, 313
See application file for complete search history.

(56) References Cited

U.S. PATENT DOCUMENTS

| | | | | |
|---|---|---|---|---|
| 5,565,975 | A * | 10/1996 | Kumon et al. | 399/302 |
| 6,332,063 | B1 | 12/2001 | Ozawa et al. | |
| 7,302,215 | B2 | 11/2007 | Ahn et al. | |
| 7,769,328 | B2 | 8/2010 | Murayama et al. | |
| 7,890,034 | B2 | 2/2011 | Murayama et al. | |
| 8,494,432 | B2 | 7/2013 | Kakehi | |
| 2006/0115304 | A1 | 6/2006 | Ahn et al. | |
| 2007/0059055 | A1* | 3/2007 | Iwata | 399/302 |
| 2007/0147894 | A1* | 6/2007 | Yokota | 399/302 |
| 2011/0103861 | A1* | 5/2011 | Kakehi | 399/400 |
| 2011/0110692 | A1* | 5/2011 | Ideguchi | 399/312 |
| 2011/0305488 | A1* | 12/2011 | Kikuno | 399/312 |
| 2012/0082489 | A1* | 4/2012 | Shirakata | 399/302 |

FOREIGN PATENT DOCUMENTS

| | | | |
|---|---|---|---|
| CN | 102667637 | A | 9/2012 |
| EP | 1666979 | A1 | 6/2006 |
| JP | 5-119636 | A | 5/1993 |
| JP | 05-341663 | A | 12/1993 |
| JP | 6-10374 | A | 1/1994 |
| JP | 9-15987 | A | 1/1997 |

(Continued)

OTHER PUBLICATIONS

Communication dated Nov. 17, 2011, forwarding a European Search Report dated Nov. 9, 2011, in European Application No. 11167390.1-2209.

(Continued)

*Primary Examiner* — Susan Lee
(74) *Attorney, Agent, or Firm* — Fitzpatrick, Cella, Harper & Scinto

(57) ABSTRACT

An image forming apparatus includes an image bearing member; a toner image forming portion for forming a toner image on the image bearing member; a rotatable belt member, stretched by a plurality of stretching members, for carrying and conveying a recording material; a transfer member for transferring the toner image from the image bearing member onto the recording material; a bias applying portion for applying a bias for transferring the toner image from the image bearing member onto the recording material; a push-up member for pushing up the belt member from an inner surface side of the belt member, perpendicular to a recording material conveyance direction; and an execution portion executing an operation in which the recording material is separated from the belt member by a push-up operation, which is performed, during rotation of the belt member, before the bias is applied to the transfer member.

7 Claims, 16 Drawing Sheets

(56) References Cited

FOREIGN PATENT DOCUMENTS

| | | | |
|---|---|---|---|
| JP | 9-96967 | A | 4/1997 |
| JP | 11-24341 | A | 1/1999 |
| JP | 2000-242090 | A | 9/2000 |
| WO | 2011/052063 | A1 | 5/2011 |

OTHER PUBLICATIONS

Chinese Office Action dated Aug. 1, 2013, in related Chinese Patent Application No. 201110143884.2 (with English translation).

* cited by examiner (a)

(b)

IMAGE FORMING APPARATUS WITH BELT MEMBER PUSH-UP FEATURE

FIELD OF THE INVENTION AND RELATED ART

The present invention relates to an image forming apparatus, in which a toner image carried on an image bearing member is transferred onto a recording material by using electrophotography, such as a copying machine or a printer. Specifically, the present invention relates to the image forming apparatus including a transfer belt for performing transfer and conveyance of the recording material.

In an electrophotographic image forming apparatus in which the recording material is nip-conveyed by the transfer belt stretched by a plurality of rollers, the recording material on the transfer belt passes through a transfer nip and then is electrostatically adsorbed by the transfer belt.

However, when rigidity of the recording material is small, the recording material cannot be separated from the transfer belt only by using curvature of a separation roller for stretching the transfer belt and by using the rigidity of the recording material. That is, the recording material is kept adhered to the transfer belt at a position of the separation roller, so that improper separation occurs. As a constitution in which waviness is provided on the transfer belt at the separation position, there is a method in which a projection is evenly formed on the surface of the separation roller for stretching the transfer belt (Japanese Laid-Open Patent Application (JP-A) Hei 9-015987). By using such a constitution, the waviness can be formed on the transfer belt at the separation position but a large tension is always exerted locally on the transfer belt. As a result, a transfer property is not stabilized by the influence of an occurrence of local abrasion of the transfer belt.

A method in which a cylindrical transfer material carrying sheet for carrying the recording material is deformed for separating the recording material but a degree of abrasion due to the deformation is reduced has been described in JP-A Hei 5-119636. In JP-A Hei 5-119636, a constitution in which a roller is provided as a push-up means which is movable to a position where a transfer sheet is to be pushed up from inside thereof and a position where the transfer sheet is not to be pushed up has been described. Thus, the constitution in which the separation of the recording material is performed by pushing up the transfer sheet with the roller and the transfer sheet is not pushed up during non-separation of the recording material has been described.

When such a constitution is applied to the transfer belt, the push-up means capable of locally pushing up the transfer belt during a separation step is disposed downstream of a transfer portion, where the toner image on the image bearing member is to be transferred onto the recording material on the transfer belt, with respect to a recording material conveyance direction. In the case where the rigidity of the recording material is small as in the case of thin paper or the like, the wariness is provided on the recording material by conveying the recording material in a state in which the transfer belt is locally pushed up, so that it is possible to increase stiffness of the recording material during the separation step.

In the image forming apparatus using the transfer belt, in order to downsize the image forming apparatus, a gap (interval) between the transfer portion, where the toner image is to be transferred onto the recording material, and the push-up means is decreased. For that reason, there is an influence on an image when the push-up means is raised during a transfer step of the toner image onto the recording material and therefore it is desirable that a constitution in which the push-up means is raised before start of the transfer is used.

On the other hand, in order to reduce the degree of the local abrasion of the transfer belt by local contact of the push-up means with the transfer belt, a push-up operation is not performed from a period before start of rotation of the transfer belt but is performed during the rotation of the transfer belt and before the transfer step is performed.

Thus, when the push-up means is pushed up during the rotation of the transfer belt, tension of the transfer belt is fluctuated to cause temporarily a fluctuation is speed of the transfer belt.

In this case, only by the contact between the image bearing member and the transfer belt, the speed fluctuation of the transfer belt due to slight fluctuation (in tension) does not influence on the image bearing member.

However, when the above operation is performed in a state in which a large voltage such as a transfer bias for transferring the toner image from the image bearing member onto the transfer belt is applied to a transfer member, the following problem occurs.

By the application of the large voltage, an electrostatic attraction force between the image bearing member and the transfer belt becomes large, so that the influence of the speed fluctuation of the transfer belt is exerted on the image bearing member and thus the speed fluctuation also occurs with respect to the image bearing member.

SUMMARY OF THE INVENTION

A principal object of the present invention is to provide an image forming apparatus capable of reducing a degree of a speed fluctuation of an image bearing member caused due to a speed fluctuation of a transfer belt by pushing up a transfer belt with a push-up means during rotation of the transfer belt.

According to an aspect of the present invention, there is provided an image forming apparatus comprising:

an image bearing member for bearing a toner image;

toner image forming means for forming a toner image on the image bearing member;

a rotatable belt member, stretched by plurality of stretching members, for carrying and conveying a recording material;

a transfer member for transferring the toner image from the image bearing member onto the recording material carried on the belt member by pressing the belt member against the image bearing member;

bias applying means for applying to the transfer member a transfer bias for transferring the toner image from the image bearing member onto the recording material;

push-up means for locally pushing up the belt member from an inner surface side of the belt member, in a direction perpendicular to a recording material conveyance direction, at a downstream-side position of the transfer member with respect to the recording material conveyance direction; and an execution portion for executing an operation in a mode in which the recording material is separated from the belt member by a push-up operation for the belt member by the push-up means, wherein in the mode, the push-up operation of the push-up means is performed, during rotation of the belt member, before the transfer bias is applied to the transfer member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) and (b) of FIG. 1 are schematic views for illustrating Embodiment 1.

Parts (a) and (b) of FIG. 2, and FIG. 3 and FIG. 4 are schematic views for illustrating separation assisting devices.

Figure 1:
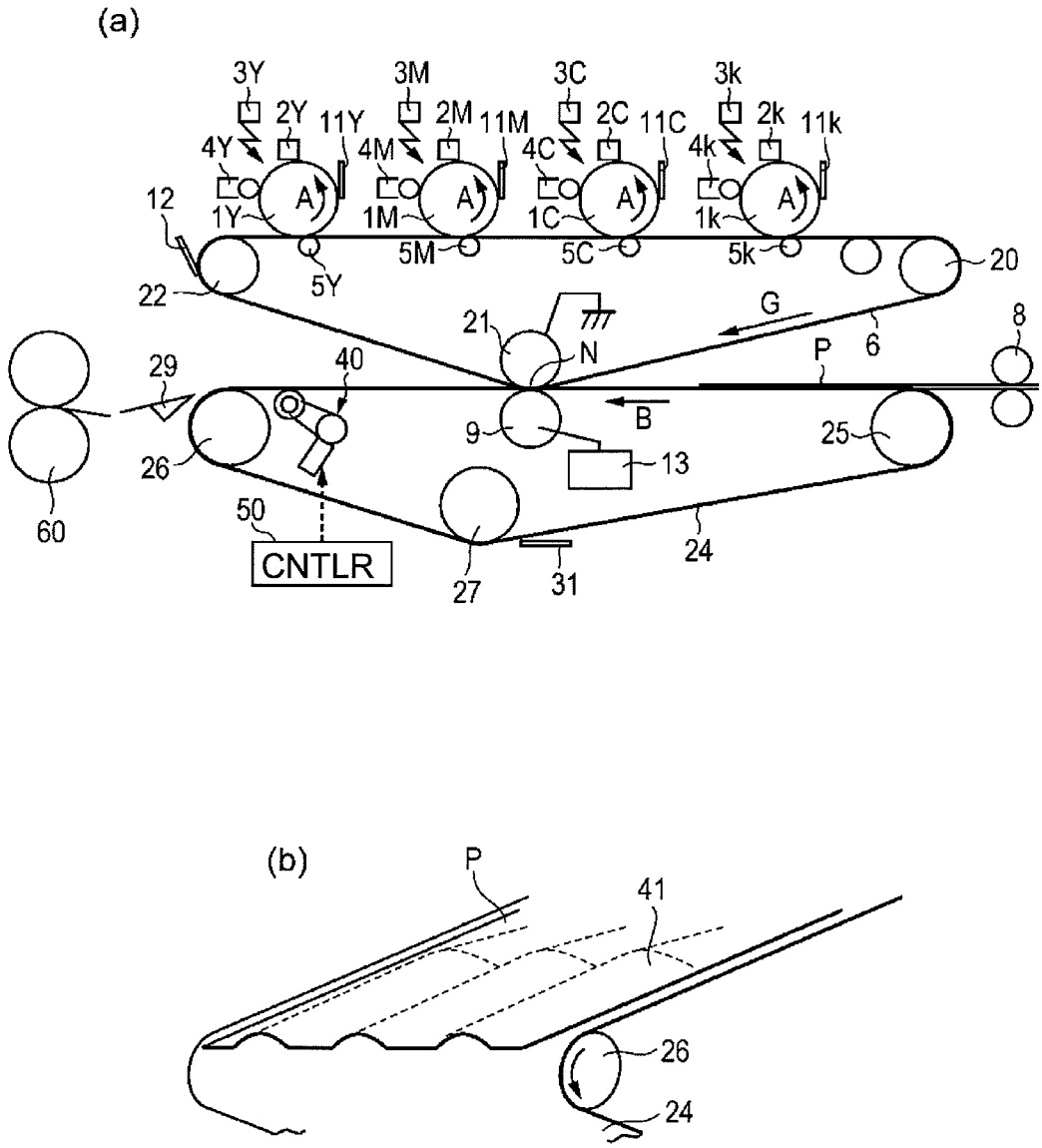

DESCRIPTION OF THE PREFERRED EMBODIMENTS (Embodiment 1)

(Image Forming Apparatus)

A constitution and operation of an image forming apparatus in Embodiment 1 will be described with reference to (a) of FIG. 1.

Photosensitive drums 1Y, 1M, 1C and 1K are rotationally driven in an arrow A direction. The photosensitive drums function as an image bearing member. The surfaces of the photosensitive drums are uniformly charged to a predetermined voltage by charging devices 2Y, 2M, 2C and 2K. The charged photosensitive drum surfaces are exposed to light by exposure devices 3Y, 3M, 3C and 3K each consisting of a laser beam scanner, so that an electrostatic latent image is formed. An output of each laser beam scanner is on/off-controlled on the basis of image information, so that the electrostatic latent image corresponding to an associated image is formed on each photosensitive drum. Developing device 4Y, 4M, 4C and 4K contain toners of yellow (Y), magenta (M), cyan (C) and black (K), respectively. A predetermined voltage is applied to the developing devices and the above-described electrostatic latent images pass through the developing devices 4Y, 4M, 4C and 4K to be developed, so that toner images are formed on the surfaces of the respective photosensitive drums 1Y, 1M, 1C and 1K. A reverse development type in which the electrostatic latent image is developed by depositing the toner on an exposed portion is used.

The toner images formed on the photosensitive drums 1Y, 1M, 1C and 1K are primary-transferred onto an intermediary transfer belt 6 by corresponding primary transfer rollers 5Y, 5M, 5C and 5K, respectively. Thus, four color toner images are superposedly transferred onto the intermediary transfer belt 6. The intermediary transfer belt 6 functions as the image bearing member by carrying thereon the toner images. The intermediary transfer belt 6 is provided so as to be contacted to the surface of the photosensitive drum 1 and is stretched by stretching rollers 20, 21 and 22 as a plurality of stretching members, and are configured to be rotationally driven in an arrow G direction at 300 mm/sec, the stretching roller 20 is a tension roller configured to control the tension of the intermediary transfer belt 6 at a constant level. The stretching roller 22 is a driving roller for the intermediary transfer belt 6.

A transfer belt 24 functions as a belt member for carrying and conveying a recording material P. The transfer belt 24 is the belt member which is stretched by stretching rollers 25, 26 and 27 as a plurality of stretching members and is movable in an arrow B direction at 300 mm/sec. The stretching roller 26 is the driving roller for the transfer belt 24. As the transfer belt 24, the belt member prepared by incorporating carbon black as an antistatic agent in an appropriate amount into resin such as polyimide or polycarbonate or various rubbers or the like so as to have a volume resistivity of $1\times10^{9}$ to $1\times10^{14}$ (Ω·cm) and a thickness of 0.07 to 0.1 (mm) is used. Further, as the transfer belt 24, an elastic member having a value of Young's modulus of 0.5 MPa or more and 10 MPa or less as measured according to the tensile testing (JIS K 6301) is used.

By using, as the transfer belt 24, the elastic member having the Young's modulus of 0.5 MPa or more as measured by the tensile testing, rotational drive of the transfer belt 24 can be effected while sufficiently keeping a shape of the belt. On the other hand, by using the member, having the Young's modulus of 10 MPa or less, which can be sufficiently deformed elastically, it becomes possible to generate waviness effectively on the recording material P by a separation assisting device (auxiliary separating device) 40 described later, thus more effectively achieving separation of the recording material P from the transfer belt 24. Further, the member which can be sufficiently deformed elastically is liable to cause a relaxation phenomenon when the member is decreased in deformation amount from a deformed state, and therefore it becomes possible to reduce a degree of abrasion (wear) of the transfer belt 24 by the separation assisting device 40.

The recording material P is accommodated in a cassette (not shown). The recording material P is, when a feeding start signal is outputted, fed from the cassette by an unshown roller on the basis of the feeding start signal to be introduced to a registration roller 8. The registration roller 8 once stops the recording material P and then feeds the recording material P to the transfer belt 24 in synchronism with the conveyance of the toner images on the intermediary transfer belt 6.

On a downstream side of the registration roller 8 with respect to a recording material conveyance direction (the direction indicated by the arrow B), a secondary transfer roller 9 for forming a transfer nip in which the toner images are to be transferred onto the recording material P carried on the transfer belt 24 is disposed. That is, the secondary transfer roller 9 functions as a transfer member for transferring the toner images from the image bearing member onto the recording material P carried on the belt member by pressing the belt member (transfer belt 24) against the image bearing member (intermediary transfer belt 6).

The secondary transfer roller 9 includes an elastic layer of an ion conductive foamed rubber (NBR) and a core metal. As the secondary transfer roller 9, a transfer roller which has an outer diameter of 24 mm and a roller surface roughness Rz of 6.0 to 12.0 (μm) and has a resistance value of $1\times10^{5}$ to $1\times10^{7}$ (Ω) as measured in an N/N (23° C., 50% RH) environment under application of a voltage of 2 kV is used. To the secondary transfer roller 9, a secondary transfer high-voltage source 13 capable of providing a variable supply bias is attached. A voltage of an opposite polarity to a charge polarity of the toner is applied, as a secondary transfer bias for transferring the toner images from the intermediary transfer belt 6 onto the recording material P, to the secondary transfer roller 9 before a leading end of the recording material P reaches the transfer nip N. When the recording material P is conveyed into the transfer nip N, the toner images on the intermediary transfer belt 6 are collectively transferred electrostatically onto the recording material P. For example, in this embodiment, the transfer is controlled so that a current in the range from +30 A to +60 A flows. At this time, a voltage value is controlled in the range from 1000 V to 5000 V. Proper current value and voltage value are determined by factors such as a drying state and environment of the recording material P and an amount of toner to be transferred.

When the recording material P separated from the transfer belt 24 after the transfer is conveyed to a fixing device 60 through a guiding surface of a recording material guide 29, the toner images are fixed on the recording material P in a heat pressing step by a fixing roller and a pressing roller which are used as a fixing member. After the toner images are fixed, the recording material P is discharged to the outside of the machine (image forming apparatus).

Incidentally, in this embodiment, the toner images on the photosensitive drums are once transferred and superposed on the intermediary transfer belt 6 to form a color (toner) image and then are transferred from the intermediary transfer belt 6 onto the recording material P on the transfer belt 24.

(Constitution of Separation Assisting Device)

As a means for pushing up the transfer belt 24 in order to assist the separation of the recording material P from the transfer belt 24, the separation assisting device 40 for performing the separation of the recording material P by locally pushing up and deforming the transfer belt 24 at a position between the secondary transfer roller 9 and a separation stretching roller 26 is provided. By using the separation assisting device 40 shown in FIG. 4, as shown in (b) of FIG. 1, the transfer belt 24 is locally pushed up in a widthwise direction. The separation assisting device 40 is provided inside an inner surface of the transfer belt 24 at a downstream side of the secondary transfer roller 9 with respect to the recording material conveyance direction.

In this embodiment, as shown in (b) of FIG. 1, the separation stretching roller 26 is disposed downstream of a separation assisting roller (auxiliary separating roller) 41 with respect to the recording material conveyance direction. At a fourth downstream side of the separation stretching roller 26, the recording material guide 29 for guiding the recording material P to the fixing device 60 is disposed adjacently to the separation stretching roller 26.

The transfer belt 24 is curved in an area in which the transfer belt 24 is contacted to the separation stretching roller 26. The recording material P having great rigidity such as a thick recording material is, when the transfer belt 24 reaches the area in which the transfer belt 24 is curved in contact with the separation stretching roller 26, separated from the transfer belt 24 by curvature of the curve of the transfer belt 24 and by great stiffness of the recording material even when the recording material P is not wavy with respect to the widthwise direction.

Figure 2:
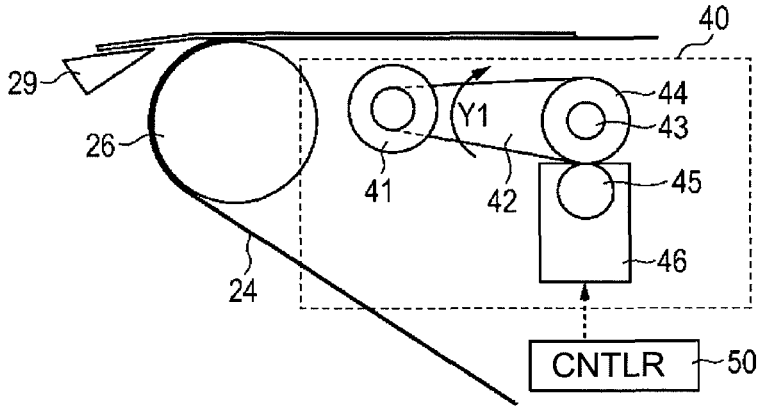
Figure 2:
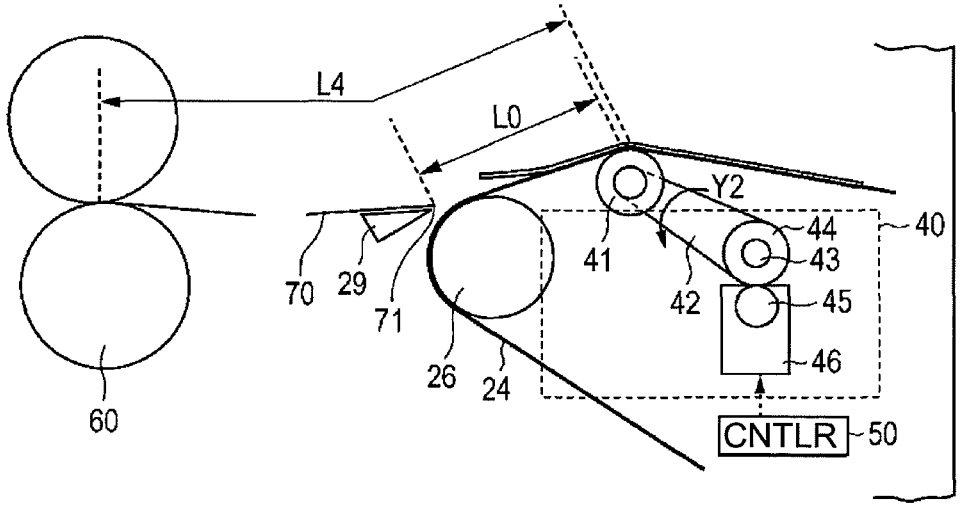

A detailed constitution and operation of the separation assisting device 40 are shown in (a) of FIG. 2 and (b) of FIG. 2. The separation assisting device 40 includes the separation assisting roller 41 which is separating member, a roller frame 42 for rotatably supporting the separation assisting roller 41, and a roller swing center shaft 43 which is a swing, center of the separation assisting roller 41. Further, the separation assisting device 40 includes a roller driving gear 44 for swinging the separation assisting roller 41 about the roller swing center shaft 43, a motor drive transmission gear 45 for transmitting a driving force of the roller driving gear 44, and a motor 46 which is a driving source. Rotation motion of the motor 46 is transmitted to the roller driving gear 44 by the motor drive transmission gear 45. Here, between the roller driving gear 44 and the roller swing center shaft 43, a bearing is provided and therefore the roller swing center shaft 43 is not influenced by the rotation drive of the motor 46 and thus the position thereof is not moved.

Part (a) of FIG. 2 shows a retraction position in which the separation assisting roller 41 is separated from the transfer belt 24 and is configured to be retracted from a push-up position. Part (b) of FIG. 2 shows the push-up position in which the separation assisting roller 41 is contacted to the inner surface of the transfer belt 24 to locally push up the transfer belt 24. The separation assisting roller 41 is movable from the roller retraction position shown in (a) of FIG. 2 to the push-up position shown in (b) of FIG. 2 in Y1 (direction) by formed rotation in a predetermined amount of the motor 36 with the roller swing center shaft 43 as the center of the movement. Further, by reverse rotation in a predetermined amount of the motor 46 with the roller swing center shaft 43 as the center of the movement, the separation assisting roller 41 is movable from the push-up position shown in (b) of FIG. 2 in Y2 direction to the retraction position shown in (a) of FIG. 2. That is, the separation assisting roller 41 is, configured to perform such swing motion by the forward and reverse rotations.

The separation assisting roller 41 is formed of ethylene-propyrene rubber (EPDM) and is 6 to 10 mm in outer diameter and 5 to 15 mm in width. When such a separation assisting roller 41 pushes up the transfer belt 24, a local projection is formed on the transfer belt 24 with respect to the widthwise direction. Here, the widthwise direction refers to a direction perpendicular to the movement direction of the moving belt surface.

In the state of (a) of FIG. 2, a distance from the separation assisting roller 41 to the separation stretching roller 26 is 4 to 8 mm. In the state of (b) of FIG. 2, the separation assisting roller 41 pushes up the belt surface of the transfer belt 24 from the inner surface side by 3 to 6 mm from a flat surface state of (a) of FIG. 2.

By the secondary transfer roller 9, electric charge of an opposite polarity to the toner charge polarity is imparted to the inner surface of the transfer belt 24, so that the recording material is in a state in which the recording material is attracted to the transfer belt 24 in the transfer nip N and at a subsequent downstream position. Further, the recording material having little rigidity such as thin paper or the like is liable to be deformed. For this reason, the waviness also occurs on the recording material by local deformation caused on the transfer belt 24 with respect to the widthwise direction by the pushing up. As a result, cross-sectional second moment of the recording material, i.e., the strength of stiffness of the recording material is increased. Part (b) of FIG. 1 is a perspective view showing the case where the local deformation with respect to the widthwise direction is caused on the transfer belt by the pushing up and the waviness is also caused on the recording material. As a result, it is possible to obtain a separation effect which is effective in separating the recording material having little rigidity such as the thin paper. That is, the recording material is separated from the transfer belt 24 at a position between a projection peak position in which the projection is formed on the transfer belt 24 and the separation stretching roller 26.

The recording material guide 29 is disposed at a position downstream of and adjacent to the separation stretching roller 26 with respect to the recording material conveyance direction. However, when the projection peak position on the transfer belt 24 is excessively remote from the recording material guide 29, there can occur such a situation that a trailing end of the recording material passes through the projection peak position before the leading end of the recording material reaches an upstream-side end portion 71 of a guide surface 70 of the recording material guide 29 with respect to the recording material conveyance direction. Here, the projection peak position refers to a central position of a range, in which the transfer belt 24 contacts the separation assisting roller 41, with respect to the conveyance direction when the transfer belt 24 is pushed up by the separation assisting roller 41. The conveyance of the thin recording material after the separation is performed by the increase in strength of the stiffness due to the waviness. That is, when the waviness is broken to result in the little stiffness before the recording material reaches the recording material guide 29, improper conveyance occurs. Therefore, a distance from the upstream-side end portion, of the guide surface of the recording material guide 29 with respect to the recording material conveyance direction, to the projection peak position may desirably be set so that a size of the recording material, with respect to the conveyance direction, used in the image forming apparatus is shorter than that of a minimum size recording material. Here, the distance from the upstream-side end portion, of the guide surface of the recording material guide 29 with respect to the recording material conveyance direction, to the projection peak position is represented by L0 in (b) of FIG. 2.

The waviness formed on the recording material is decreased with an increase in distance from the projection peak position on the belt member. However, when the fixing device 60 is excessively close to the projection peak position, there is a possibility that the recording material is conveyed to the fixing device 60 while the waviness of the recording material is relaxed. In order to relax the waviness, an increase in distance between the fixing device 60 and the projection peak position is effective.

In this embodiment, a distance of a path along which the recording material is conveyed from the projection peak position to the upstream-side end portion of the nip of the fixing device 60 with respect to the recording material conveyance direction is represented by L4 in (b) of FIG. 2. Here, L4 is the sum of the distance from the upstream-side end portion, of the guide surface of the recording material guide 29 with respect to the recording material conveyance direction, to the projection peak position and a distance from the upstream-side end portion, of the guide surface of the recording material guide 29 with respect to the recording material conveyance direction, to an entrance of the fixing nip. In the state of (b) of FIG. 2, if L4 is about 200 mm, even when the separation assisting roller 41 is located at the push-up position, the recording material is conveyed to the fixing device 60 in a state in which the waviness is sufficiently relaxed. Further, importance is placed on suppression of excessive upsizing of the image forming apparatus with respect to the recording material conveyance direction and therefore L4 is set at a value which is smaller than a length of a maximum size recording material, with respect to the recording material conveyance direction, which can be conveyed in the image forming apparatus.

Incidentally, the distance in which the waviness of the recording material is sufficiently relaxed until the recording material reaches from the contact portion to the fixing portion varies depending on conditions of the separation assisting roller 41 such as a push-up height of the separation assisting roller, the roller shape, a manner of an occurrence of the waviness, a size of the separation assisting roller 41, an interval of the separation assisting rollers 41 and the number of the separation assisting rollers 41.

Therefore, the importance is placed on the waviness relaxation until the recording material reaches the fixing portion irrespective of the conditions of the separation assisting roller 41 rather than the upsizing of the image forming apparatus with respect to the recording material conveyance direction, and the distance from the projection peak position to the fixing device 60 may also be set at a value which is not less than the maximum size of passable paper. In this case, the time when the leading end of the recording material reaches the fixing device 60 is after the trailing end of the recording material passes through the projection peak position. Irrespective of the conditions of the separation assisting roller 41, even when the separation assisting roller 41 is located at the push-up position, it is possible to suppress the conveyance of the recording material in the wavy state.

The number of the separation assisting rollers 41 provided in the separation assisting device 40 may also be one in the area through which the recording material passes. However, in this case, a waviness range of the recording material with respect to the widthwise direction of the recording material becomes narrow. In order to provide the waviness with respect to the widthwise direction of the recording material, it is preferable that a plurality of the separation assisting rollers 41 are provided, with respect to the widthwise direction, within a range in which the recording material passes.

On the other hand, in the case where the plurality of the separation assisting rollers 41 are disposed, an arrangement interval of the separation assisting rollers 41 is excessively narrow, the transfer belt 24 is raised as a whole, so that a plurality of local projections are not formed with respect to the belt widthwise direction and thus a separation property cannot be enhanced. In order to form the plurality of local projections with respect to the belt widthwise direction, there is a need to provide a wide interval.

Figure 3:
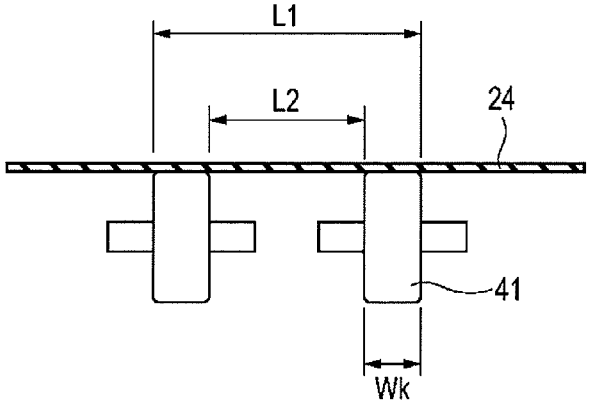

In this embodiment, with respect to the direction perpendicular to the movement direction of the transfer belt 24, as shown in FIG. 3, a width of each separation assisting roller 41 and the interval of the separation assisting rollers 41 are set. L1 represents a length between outer sides of adjacent separation assisting rollers 41 and Wk represents the width of each separation assisting roller 41. L2 represents a length between opposing (inner) sides of the adjacent separation assisting rollers 41 and is determined by L1−2Wk. In this embodiment, L2 is set at a value which is 2Wk or more. That is, a length in which the separation assisting rollers 41 are not contacted to the transfer belt 24 is longer than a length in which the separation assisting rollers 41 are contacted to the transfer belt 24. As a result, unevenness is liable to be provided on the transfer 24 by local by providing the projections at a plurality of positions with respect to the belt widthwise direction, compared with the case where the transfer belt 24 is raised as a whole.

Figure 4:
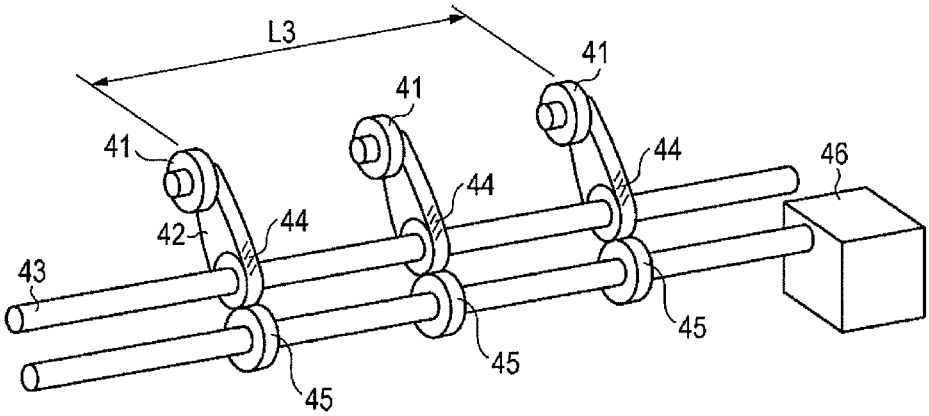

As shown in FIG. 4, in this embodiment, three separation assisting rollers 41 are provided with respect to the widthwise direction. The interval L2 between the adjacent separation assisting rollers 41 is 125 mm. An interval between both end separation assisting rollers 41 is 250 mm. The central separation assisting roller 41 is disposed so as to be located at a substantially central portion of the recording material, to be conveyed, so that the center of the recording material with any width size with respect to the widthwise direction substantially coincides with a common reference line. Particularly, in the case where a thin A4-sized recording material of 297 mm in size with respect to the widthwise direction is conveyed, the A4-sized recording material is raised at three positions. This is effective in enhancing the separation property of the A4-sized recording material.

(Control of Separation Assisting Device)

Figure 5:
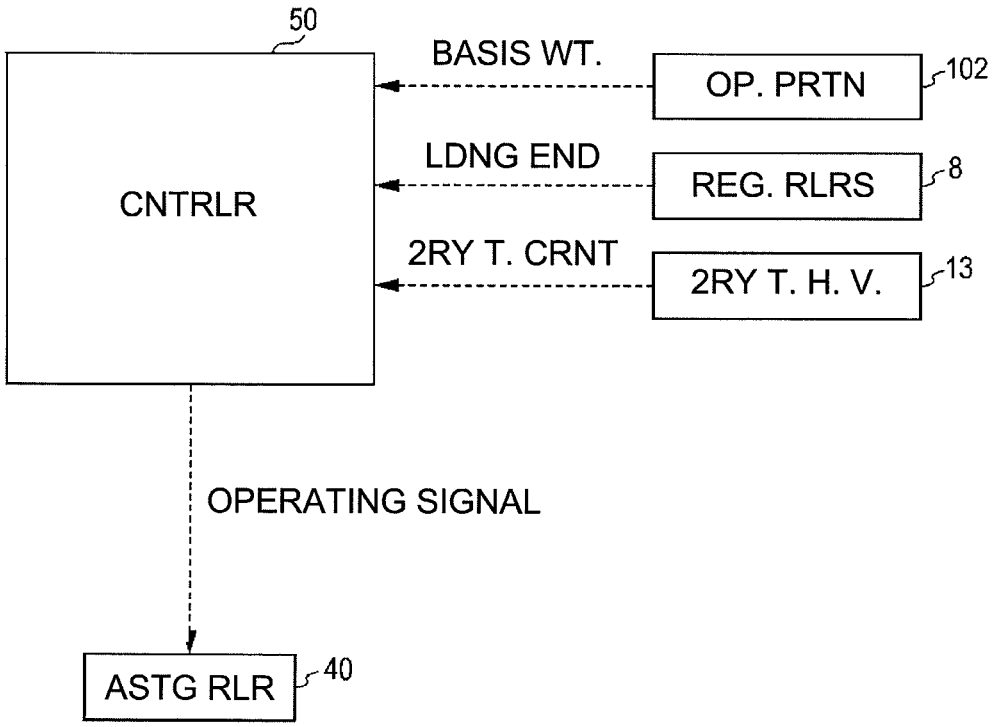
FIGS. 5 to 8 are schematic views for illustrating Embodiment 1.

An operation position of the separation assisting device 40 is controlled by a separation assisting control circuit (control portion) 50. A relationship of this control is shown in FIG. 5. Control of an operation position signal of the separation assisting device 40 is based on recording material position information obtained on the basis of basis weight information of the recording material P designated by a user, recording material feeding timing by the registration roller pair 8 and a conveyance speed of the recording material. The control portion 50 includes CPU, ROM and RAM. The information from an operating portion 102 at which the user operates the image forming portion is inputted into the operation portion 50. Operation timing of the registration roller is inputted into the control portion 50. Information of a secondary transfer current value from the secondary transfer high-voltage source is inputted into the control portion 50. The control portion 50 controls the operation of the motor for the separation assisting device 40.

Incidentally, the basis weight is a unit representing a weight per unit area ($g/m^2$) and is generally used as a value showing a thickness of the recording material.

In this embodiment, the following two patterns have been stored in the ROM in advance.

In the case where the recording material has the basis weight of 60 $g/m^2$ or less, the separation assisting roller 41 is located at the push-up position to locally projects the transfer belt 24 with respect to the widthwise direction. The separation of the recording material from the transfer belt 24 is performed by forming the local projections by the pushing up.

In the case where the recording material has the basis weight larger than 60 $g/m^2$, the separation assisting roller 41 is located at the retraction position At the retraction position, the separation assisting roller 41 is separated from the transfer belt 24. The separation of the recording material from the transfer belt 24 is performed by using the curvature of the stretching roller 26.

That is, the separation assisting device 40 executes an operation in a mode in which the separation assisting roller 41 is pushed up with respect to the recording material having a specific basis weight (first basis weight). Further, the separation assisting device 40 executes an operation in a mode in which with respect to the recording material having a second basis weight larger than the first basis weight, the separation assisting roller 41 is not pushed up but the recording material is separated by the stretching roller. That is, the separation assisting device 40 functions as an execution portion for executing the operations in these modes.

With respect to the basis weight, there are the case where the user inputs the basis weight at the operating portion 102 and the case where the basis weight of the recording material is inputted at an accommodating portion in which the recording material is accommodated. On the basis of the information on the basis weight inputted into the image forming apparatus in these cases, the control portion 50 determines the operation of the separation assisting device 40.

(Control Timing of Separation Assisting Roller)

(Single Sheet Print Mode)

Figure 6:
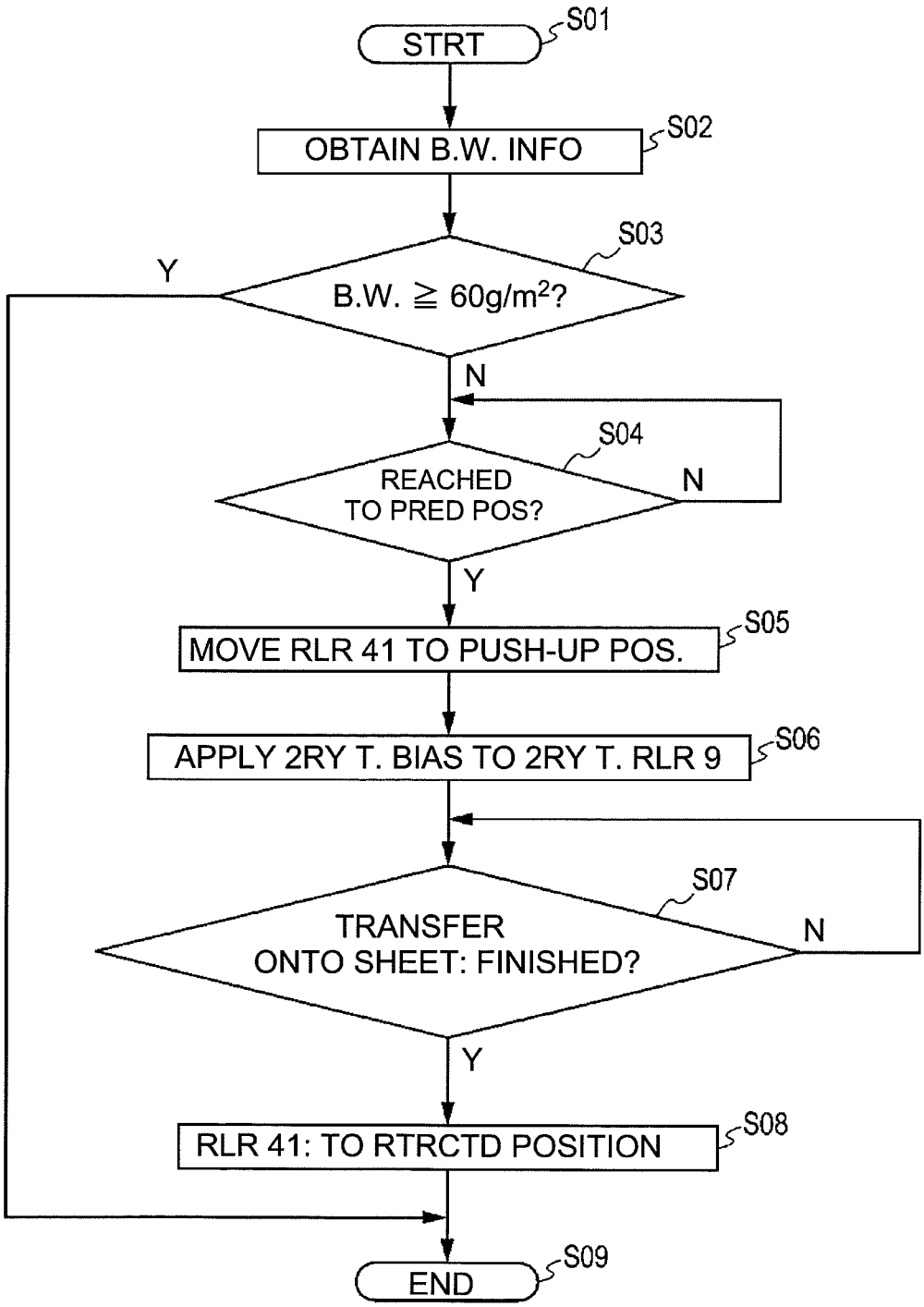

A flowchart of operation control of the separation assisting device 40 in the case of a single sheet print mode will be described with reference to FIG. 6. When the control is started (S01), the basis weight information of the recording material set by the user at a user operating portion 102 is read (S02). The basis weight is judged as to whether or not it is larger than 60 g/m2 (S03), In the case where the basis weight of the recording material is larger than 60 g/m2 in S03, the recording material is conveyed while the separation assisting roller is kept at the retraction position, and the contact is ended (S09). In the case where the basis weight of the recording material P set by the user is 60 g/m2 or less, in order to separate the recording material having little stiffness from the transfer belt 24, there is a need to perform the operation for forming the local projection by pushing up the transfer belt 24 by the separation assisting roller 41. In the case where the set basis weight of the recording material P is 60 g/m2 or less, whether or not the leading end of the recording material reaches the predetermined position is judged (SO4). The predetermined position is a position which is downstream of the registration roller 8 and is upstream of the secondary transfer roller 9 with respect to the recording material conveyance direction. The position of the recording material is judged by a method in which it is detected from an elapsed time from the passing of the recording material through the registration roller 8 and the conveyance speed of the recording material or by a method in which the position of the recording material is detected by disposing a detecting member for detecting the passing of the recording material. In the case where the recording material reaches the predetermined position, separation assisting roller 41 is moved in the Y1 direction and is disposed at the push-up position in which the transfer belt 24 is pushed up (S05). Timing when the separation assisting roller 41 is disposed at the push-up position is set so as to be before the secondary transfer bias for transferring the toner images from the intermediary transfer belt 6 onto the recording material is applied. Thereafter, the secondary transfer bias is applied to the secondary transfer roller 9 (S06). Here, the separation assisting roller 41 starts an operation, by which the separation assisting roller 41 is moved to the push-up position, with as push-up signal as a trigger signal. Timing of sending the push-up signal is set in advance in such a manner that the separation assisting roller 41 which starts the movement with the push-up signal as the trigger signal reaches the push-up position and thereafter the transfer bias is applied. On the transfer belt 24 which has been deformed by the separation assisting roller 41, the recording material P is increased in strength of stiffness by waviness and thus is separated from the transfer belt 24. The leading end of the recording material P separated from the transfer belt 24 reaches the guide surface of the recording material guide 29 and Whether or not the toner image transfer onto the recording material P is completed is judged (S07). When a retracting operation by which the separation assisting roller 41 is retracted is performed before the leading end of the recording material P reaches the guide surface of the recording material guide 29, there is a possibility that paper jam occurs between the transfer belt 24 and the recording material guide 29. Therefore, whether or not the leading end of the recording material P has reached the guide surface of the recording material guide 29 is judged. The reason why whether or not the toner image transfer onto the recording material P is judged is that There is a possibility that an impact is exerted on the transfer belt 24 to disturb the transfer when the retracting operation is performed during the toner image transfer onto the recording material P. In the case where the recording material reaches the guide surface of the recording material guide 29, judgment that the separation is performed is made and the separation assisting roller is moved to the retraction position (S08), and thus the control is ended (S09).

In this embodiment, the control is effected on the basis of the basis weight information inputted by the user but the basis weight may also be judged by providing a sensor on or in the image forming apparatus and by using the sensor. When the operation of the separation assisting device 40 is controlled on the basis of the basis weight judged by the sensor, even in the case where the recording material having a small basis weight is erroneously accommodated in a cassette for the recording material having a large basis weight, the push-up operation is performed. That is, even when an error in the position in which the recording material having the small basis weight is accommodated is made, it is possible to suppress an occurrence of improper separation of the recording material having the small basis weight.

As the sensor, a weight sensor for detecting the weight of the conveyed recording material is provided in a recording material conveyance path and then the basis weight of the recording material may be judged on the basis of the weight detected by the weight sensor and size information (area) of the recording material. Alternatively, a transmission sensor for detecting a light transmittance is provided in the recording material conveyance path and the thickness of the recording material may also be judged from the transmittance of light passing through the conveyed recording material.

Next, with reference to FIG. 7, timing when the separation assisting roller is controlled in the single sheet print mode will be described.

Figure 7:
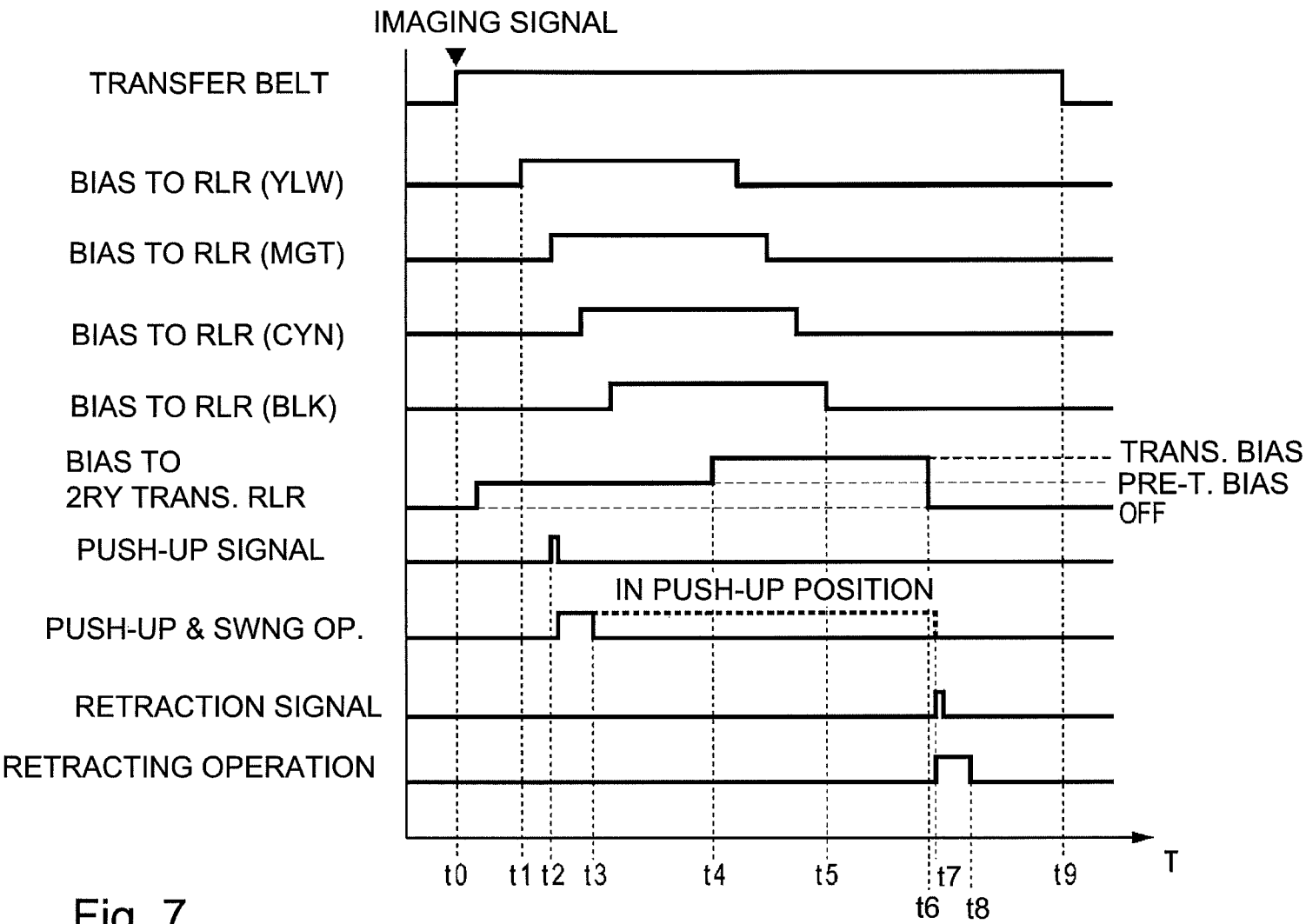

FIG. 7 shows the case where an A3-sized recording material is conveyed. Here, the A3 size is such that the size of the recording material, of the recording materials to be recommended to be conveyed in the image forming apparatus, conveyed in the recording material conveyance direction is maximum.

When an image forming signal is inputted into the image forming apparatus, rotations of each photosensitive drum, the intermediary transfer belt and the transfer belt are started (t0). After a preset interval from the start of the rotations, with respect to the direction in which the intermediary transfer belt 6 is moved, from the upstream side, the toner images are transferred from the photosensitive drums 1Y, 1M, 1C and 1K onto the intermediary transfer belt 6. The respective color toner images are superposed on the intermediary transfer belt 6, so that a color image is formed. The transfer of the respective color toner images onto the intermediary transfer belt 6 is started from the photosensitive drum 1Y which is located on the uppermost-stream side with respect to the direction in which the intermediary transfer belt 6 is moved (t1).

In a period in which the primary transfer from at least one drum onto the intermediary transfer belt 6, the push-up signal which is the trigger signal for starting the push-up operation for pushing up the transfer belt 24 by the separation assisting roller 41 to move the transfer belt 24 toward the push-up position is sent to the control circuit 50 (t2). After the push-up operation for moving the transfer belt 24 toward the push-up position by the separation assisting roller 41 is completed (t3), the transfer bias for transferring the toner images from the intermediary transfer belt 6 onto the recording material is applied to the secondary transfer roller (t4). Here, the completion of the push-up operation means that the separation assisting roller 41 has reached the push-up position. Thereafter, the toner image transfer from the photosensitive drum 1K onto the intermediary transfer belt 6 is completed (t5). After the transfer bias is applied to the secondary transfer roller 9, the toner image transfer from the photosensitive drum 1K onto the intermediary transfer belt 6. This is because it takes time to form the toner images for a maximum-sized sheet on the intermediary transfer belt 6.

The timing (t4) when the transfer bias is applied to the secondary transfer roller 9 is determined on the basis of the timing (t1) when the image is formed on the intermediary transfer belt 6 and a time t10 required from the transfer (formation) of the toner image from the photosensitive drum 1Y onto the intermediary transfer belt 6 to the reaching to the secondary transfer roller 9. After a lapse of the required time t10 from t1, the secondary transfer is started. The timing (t4) when the transfer bias is applied to the secondary transfer roller 9 is set at a time before the lapse of the required time t10 from t1 so that the transfer bias application is performed before the start of the secondary transfer. The push-up signal is sent with the timing (t2) so as to ensure a preset time period between t2 and t4 in order that the push-up operation is completed before the time t4. By setting, in advance, the push-up signal sending timing (t2) and the timing (t4) when the transfer bias is applied to the secondary transfer roller 9 in the control circuit 50, control such that the transfer bias is applied after the completion of the push-up operation is effected. Here, the reason shy the push-up signal sending timing is set so that the push-up operation is completed before the transfer bias application timing (t4) will be described.

A voltage value of the transfer bias is large (3 to 5 kV). For that reason, during the application of the transfer bias to the secondary transfer roller 9, the transfer belt 24 is electrostatically absorbed strongly by the intermediary transfer belt 6. On the other hand, when the push-up operation is performed during the rotation of the transfer belt 24, the tension of the transfer belt 24 is temporarily fluctuated by the push-up operation and therefore the movement speed of the transfer belt 24 is fluctuated. This fluctuation of the movement speed is also influenced on the secondary transfer portion at which the toner images on the intermediary transfer belt 6 are to be transferred onto the transfer belt 24. In this embodiment, a part of the roller for stretching the transfer belt 24 is movably supported by the elastic member and is configured to be adapted to the fluctuation of the tension. However, the temporary fluctuation cannot be removed completely. For that reason, the above-described phenomenon occurs.

Thus, the movement speed fluctuation occurred at the secondary transfer portion also influences on the intermediary transfer belt 6 when the transfer belt 24 is strongly adsorbed by the intermediary transfer belt 6.

As a result, in the case where the image formation (primary transfer) from the photosensitive drum onto the intermediary transfer belt 6 is effected, there is a possibility of an occurrence of image deterioration. Further, even in the case where the image is not formed on the intermediary transfer belt 6 during the pushing up, when an interval between the push-up operation and the start of the image formation is short, the image is formed in a state in which the movement speed is unstable and thus there is a possibility that the image deterioration such as color misregistration with respect to a color image occurs. Therefore, in this embodiment, the push-up signal sending timing is set so that the push-up operation is completed before the timing (t4) of the start of the transfer bias application to the secondary transfer roller 9.

Further, in the constitution in this embodiment, a pre-transfer bias which is a voltage smaller than an absolute value of the transfer bias is applied before the transfer bias for performing the transfer operation onto the recording material is applied to the secondary transfer roller 9. This is because when a change in applied voltage to the secondary transfer roller is excessively large, there is a possibility of an occurrence of overshooting. In this embodiment, the transfer bias is subjected to constant voltage control. During the transfer operation, a voltage in the neighborhood of 3 kV is applied as the transfer bias. As a result, a current in the neighborhood of 30 μA flows during the transfer operation. In an application period of the pre-transfer bias, the constant voltage control with +500 V is effected. Compared with the transfer bias of 3 kV, the pre-transfer bias is +500 V which is small and therefore in the case where the voltage applied to the transfer roller is small, the influence of the electrostatic attraction on the speed fluctuation is small. In this embodiment, the pre-transfer bias is a voltage which is not move than a voltage of +1.5 kV at which the speed fluctuation of the intermediary transfer belt 6 due to the electrostatic attraction is small.

When the leading end of the recording material after the transfer reaches the end portion 71 of the guide surface of the recording material guide 29 and the toner image transfer from the intermediary transfer belt 6 onto the recording material is completed, the secondary transfer roller 9 is switched from the transfer bias-applied state to the voltage-off state (t6).

Thereafter, a retraction signal which is a trigger signal for starting a retraction operation for moving the separation assisting roller 41 toward the retraction position is sent to the control circuit 50 (t7). The separation assisting roller 41 reaches the retraction position (t8). Thereafter, the leading end of the recording material reaches the fixing device 60 and the image forming operation is ended, so that the rotations of the respective photosensitive drums, the intermediary transfer belt 6 and the transfer belt 24 are ended (t9).

Incidentally, in this embodiment, the retraction operation of the separation assisting roller is not performed during the transfer operation but is performed after the completion of the transfer operation. In this embodiment, when the transfer operation is completed, the transfer bias is turned off after a lapse of a preset interval, i.e., 0.5 second in this embodiment. Incidentally, the retraction operation in this embodiment is performed after the transfer bias is turned off. Incidentally, in such a case where the rotation of the intermediary transfer belt 6 is stopped after the retraction operation as in the case of the single sheet print mode, the image formation is not continuously effected and therefore there is of no problem even in the constitution in which the separation assisting roller is retracted in the state in which the transfer bias is turned off.

In this embodiment, the push-up operation is completed before the secondary transfer bias is applied to the secondary transfer roller 9. For that reason, it is possible to suppress disturbance of the speed fluctuation of the intermediary transfer belt 6 caused due to the speed fluctuation of the transfer belt 24 by the push-up operation.

Incidentally, in this embodiment, the push-up operation is performed after the time (t1) when the image is started to be formed on the intermediary transfer belt but is not limited thereto and may also be performed before the time (t1) so long as the push-up operation is performed during the rotation of the transfer belt 24. During the period from t1 to t4, the voltage applied to the secondary transfer roller 9 is the pre-transfer bias having the voltage value which is smaller than the transfer bias, so that the electrostatically strong attraction force is not exerted as in the case where the transfer bias is applied to the secondary transfer roller 9. However, also in the case where the pre-transfer bias is applied to the secondary transfer roller 9, when the intermediary transfer belt 6 contacts the transfer belt 24 at the transfer portion, impact is exerted on the transfer belt 24 and there is a possibility that the impact is transmitted to the intermediary transfer belt 6. Therefore, even when the impact is exerted on the transfer belt 24 before the transfer bias is applied to the secondary transfer roller 9, important is placed on that the image on the intermediary transfer belt 6 is not disturbed and the constitution in which the push-up operation is performed before the time (t1) of the start of the image formation on the intermediary transfer belt may also be employed.

In this embodiment, the pre-transfer bias is applied to the secondary transfer roller 9 before the transfer bias is applied but is not limited to this embodiment. Before the transfer bias is applied, the voltage may also be not applied to the secondary transfer roller 9 (off state).

(Continuous Print Mode)

Figure 8:
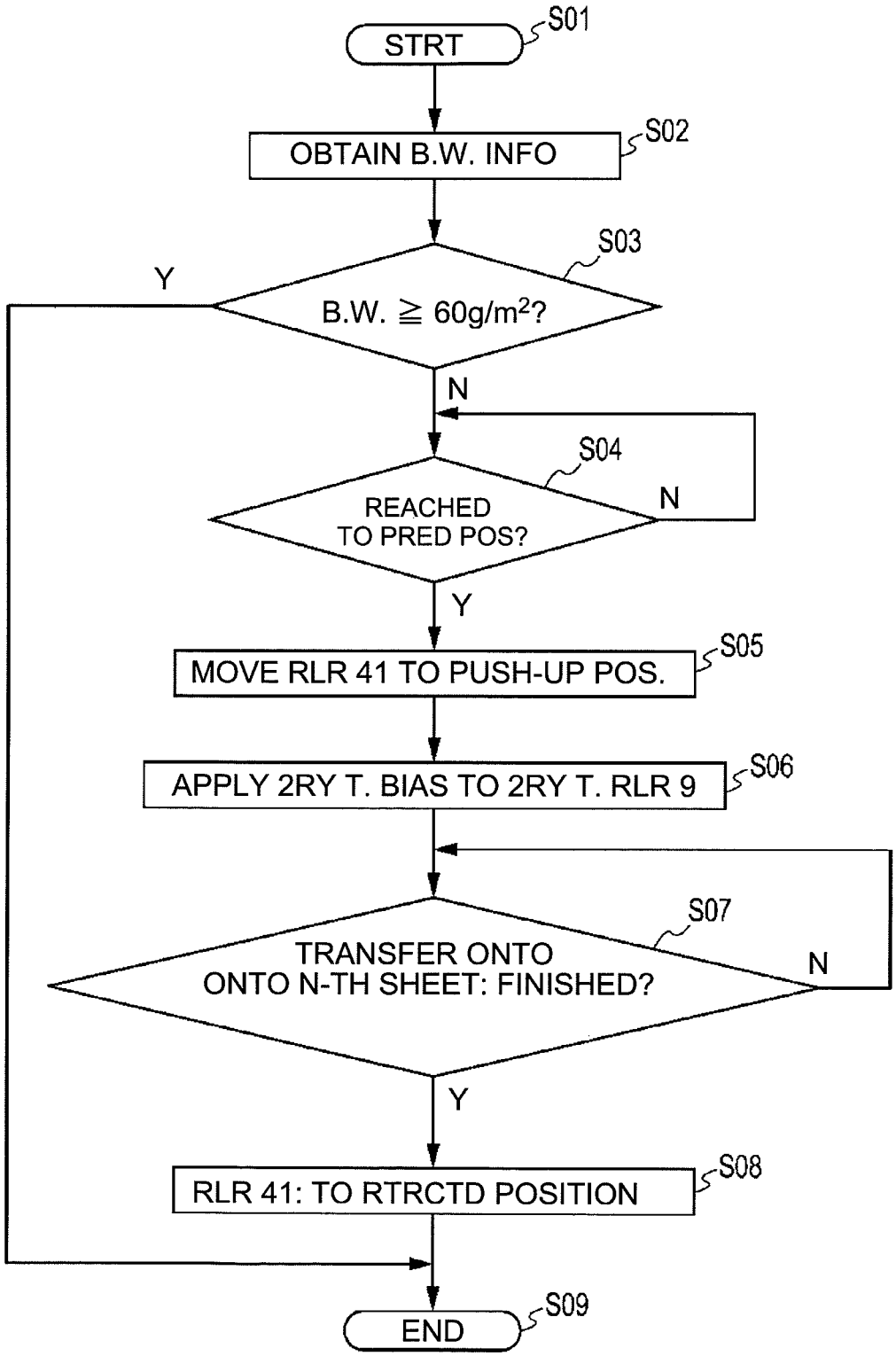

A flowchart of operation control of the separation assisting roller in the case where (n) sheets of the recording material are continuously conveyed will be described with reference to FIG. 8. When the control is started (S01), the basis weight information of the recording material set by the user at a user operating portion 102 is read (S02). The basis weight is judged as to whether or not it is larger than 60 g/m$^2$ (S03). In the case where the basis weight of the recording material is larger than 60 g/m$^2$ in S03, the separation assisting roller is disposed at the retraction position (S07). In the case where the basis weight of the recording material P set by the user is 60 g/m$^2$ or less, whether or not a first sheet of the recording material reaches the predetermined position is judged (S04). The predetermined position is a position which is downstream of the registration roller 8 and is upstream of the secondary transfer roller 9 with respect to the recording material conveyance direction. The position of the recording material is judged by a method in which it is detected from an elapsed time from the passing of the recording material through the registration roller 8 and the conveyance speed of the recording material or by a method in which the position of the recording material is detected by disposing a detecting member for detecting the passing of the recording material. In the case where the recording material reaches the predetermined position, the separation assisting roller 41 is moved in the Y1 direction and is disposed at the push-up position in which the transfer belt 24 is pushed up (S05). Timing when the separation assisting roller 41 is disposed at the push-up position is set so as to be before the secondary transfer bias for transferring the toner images from the intermediary transfer belt 6 onto the recording material is applied. Thereafter, the secondary transfer bias is applied to the secondary transfer roller 9 (S06). On the transfer belt 24 which has been deformed by the separation assisting roller 41, the first sheet of the recording material is increased in strength of stiffness by waviness and thus is separated from the transfer belt 24. Thereafter, the leading end position of the final (n-th) sheet of the recording material reaches the guide surface of the recording material guide 29 and whether or not the toner image transfer onto the n-th sheet of the recording material is completed is judged (S07). The separation assisting roller 41 is kept at the push-up position until the leading end position of the n-th sheet of the recording material reaches the guide surface of the recording material guide 29 and the toner image transfer onto the n-th sheet of the recording material is judged as being completed in S07. When the leading end position of the n-th sheet of the recording material reaches the guide surface of the recording material guide 29 and the toner image transfer onto the n-th sheet of the recording material is judged as being completed, the separation assisting roller 41 is moved toward the retraction position (S08), and the control is ended (S09).

Figure 9:
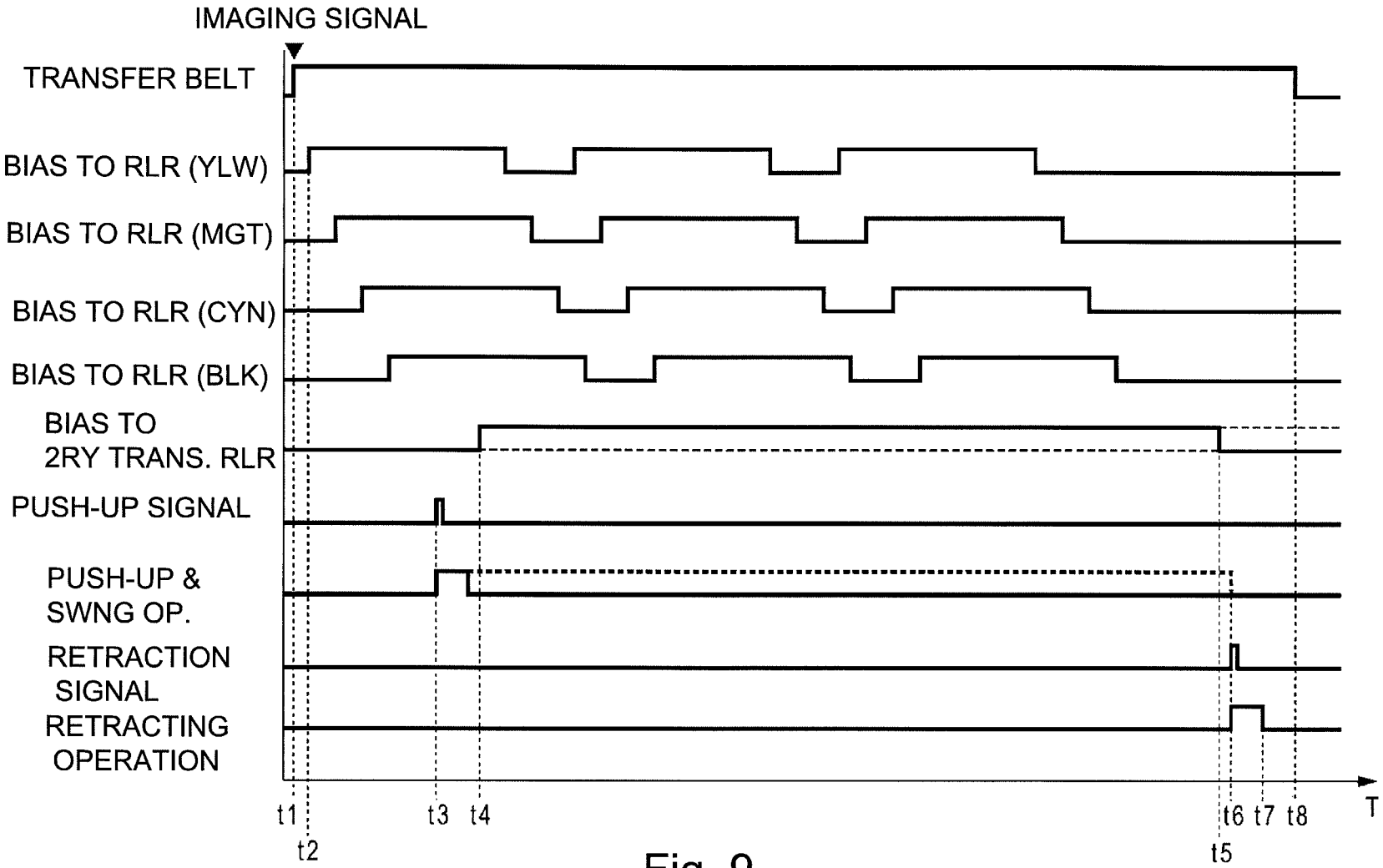
FIGS. 9, 10 and 11 are schematic views for illustrating Embodiment 2.

Next, with reference to FIG. 9, timing of contact of the separation assisting roller in the case where sheets of ultrathin paper are continuously passed will be described. In this case, A3-sized recording material is conveyed as a maximum-sized sheet, with respect to the conveyance direction, of sheets of the recording materials which are recommended to be conveyed.

In this embodiment, timing when the separation assisting roller is pushed up is the same as in the case where the sheets of the recording material are not continuously conveyed (not-continuous sheet passing) as described above.

That is, when the image forming signal is sent and the rotation of the transfer bias is started (t0), the toner image is transferred (formed) from the photosensitive drum 1Y onto the intermediary transfer belt 6 (t1). The separation assisting roller push-up signal is sent (t2), so that the separation assisting roller 41 is started to move. When the separation assisting roller 41 reaches the push-up position (t3), the transfer bias is applied to the secondary transfer roller 9 (t4). Thereafter, during the step of performing a plurality of image forming operations for forming the toner images on the recording materials, in a period between consecutive image forming operations, the separation assisting roller 41 is held at the push-up position. In the final image forming operation, when the application of the secondary transfer bias to the secondary transfer roller 9 is stopped (t5), the retraction signal for retracting the separation assisting roller 41 is sent (t6). When the separation assisting roller 41 reaches the retraction position (t7), the rotation of the transfer belt 24 is stopped and the image formation is ended (t8).

In this embodiment, the interval between the recording materials (sheet interval) is 50 mm, which is small for the purpose of performing such an operation that the separation assisting roller which has been pushed up in the interval between the recording materials is retracted and then is pushed up again in the same interval between the recording materials, and therefore the push-up of the separation assisting roller is continued in the interval between the recording materials.

In this embodiment, as an interval in which the waviness of the recording material is sufficiently relaxed in the fixing device 60, a locating position of the fixing device 60 from the projection peak position is set at 200 mm.

Here, "the waviness of the recording material is sufficiently relaxed" means that the waviness of the recording material is sufficiently relaxed in the case where a vertical difference in height between a portion corresponding to the separation assisting roller and a portion which does not correspond to the separation assisting roller is 1 mm or less with respect to a direction perpendicular to the recording material conveyance direction.

Figure 10:
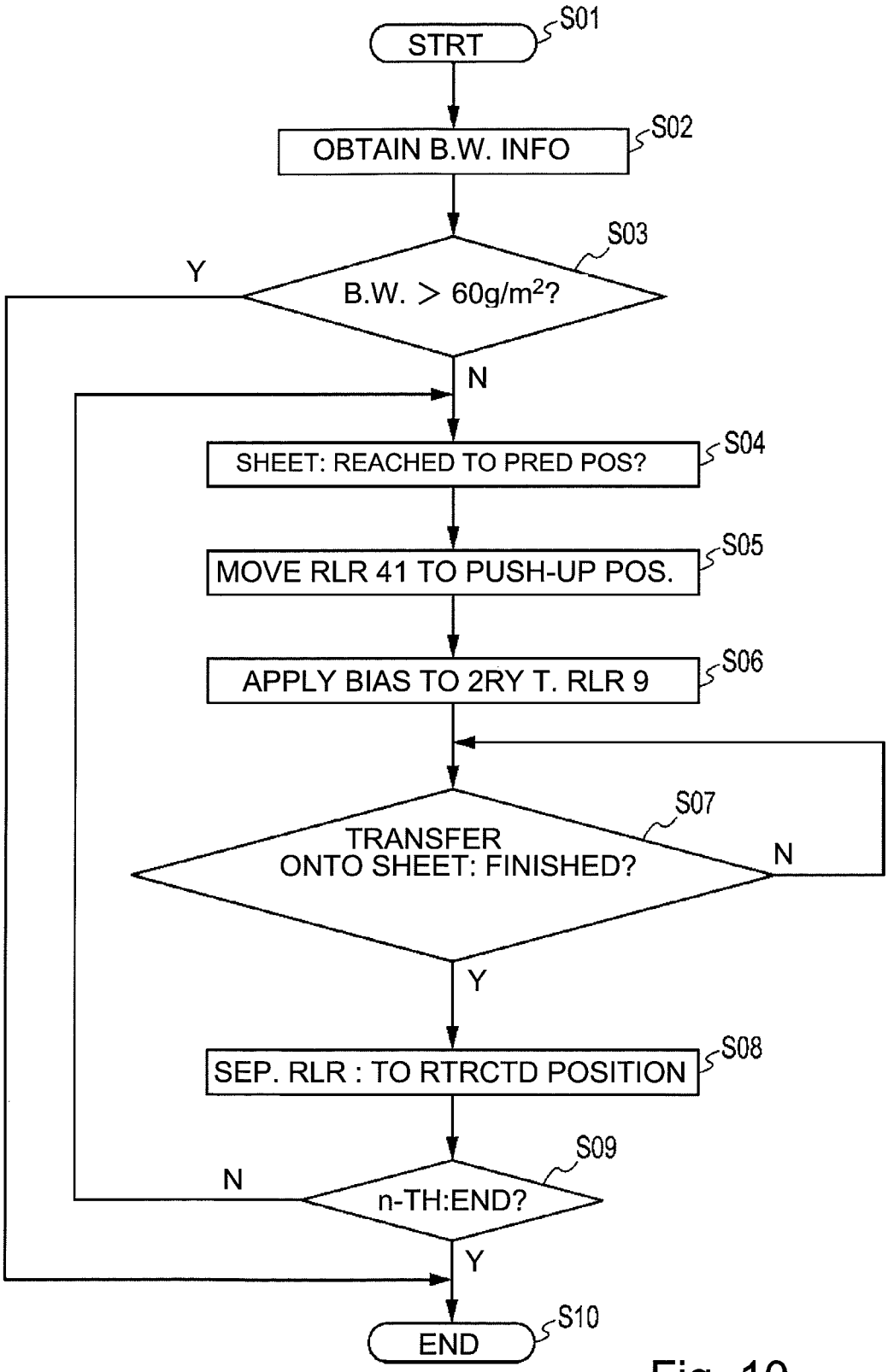

(Embodiment 2): On-Off Control of Pushing Up in Sheet Interval in Continuous Print Mode Portions which overlap with those in Embodiment 1 are the same as those in Embodiment 1 and therefore will be omitted from the description. With reference to FIG. 10, a flowchart of separation assisting roller control in Embodiment 2 will be described.

In this embodiment, a constitution in which raising and lowering operation is performed in the case where the interval between the recording materials is longer than a predetermined interval when the rotation of the transfer belt 24 is continuously effected is employed.

Examples of this case may include the case where the number of image forming jobs permit time is decreased and the case where a job and a subsequent job are made in succession when a plurality of image forming jobs are inputted. In the case of the passing of the ultrathin paper, the constitution in this embodiment is also applicable to the image forming apparatus which is operable in a normal mode in which the constitution in which the interval between the recording materials is longer than the predetermined interval is employed.

When the control is started (S01), the basis weight information of the recording material set by the user at a user operating portion 102 is read (S02). The basis weight is judged as to whether or not it is larger than 60 g/m$^2$ (S03). In the case where the basis weight of the recording material is larger than 60 g/m$^2$ in S03, the separation assisting roller is kept at the retraction position and the contact is ended (S10). In the case where the basis weight of the recording material is 60 g/m$^2$ or less, whether or not the recording material reaches the predetermined position is judged (S04). The predetermined position is a position which is downstream of the registration roller 8 and is upstream of the secondary transfer roller 9 with respect to the recording material conveyance direction. In the case where the recording material reaches the predetermined position, the separation assisting roller 41 is moved in the Y1 direction and is disposed at the push-up position in which the transfer belt 24 is pushed up (S05). When the push-up operation is completed, the transfer bias is applied to the secondary transfer roller 9 (S06). On the transfer belt 24 which has been deformed by the separation assisting roller 41, the recording material P is increased in strength of stiffness by waviness and thus is separated from the transfer belt 24 before the transfer belt 24 reaches the area in which the transfer belt 24 is contacted to the separation stretching roller 26. The leading end position of the recording material P reaches the guide surface of the recording material guide 29 and whether or not the toner image transfer onto the recording material P is completed is judged (S07). In the case where the recording material the recording material reaches the guide surface of the recording material guide 29, the recording material is judged as being separated and the separation assisting roller is moved to the retraction position (S08).

Whether not the sheets of the recording material to be conveyed are conveyed is judged (S09). In the case where the (n) sheets of the recording material are judged as being not conveyed, the procedure is returned to S04. In the case where the (n) sheets of the recording material are judged as being conveyed, the control is ended (S10).

Figure 11:
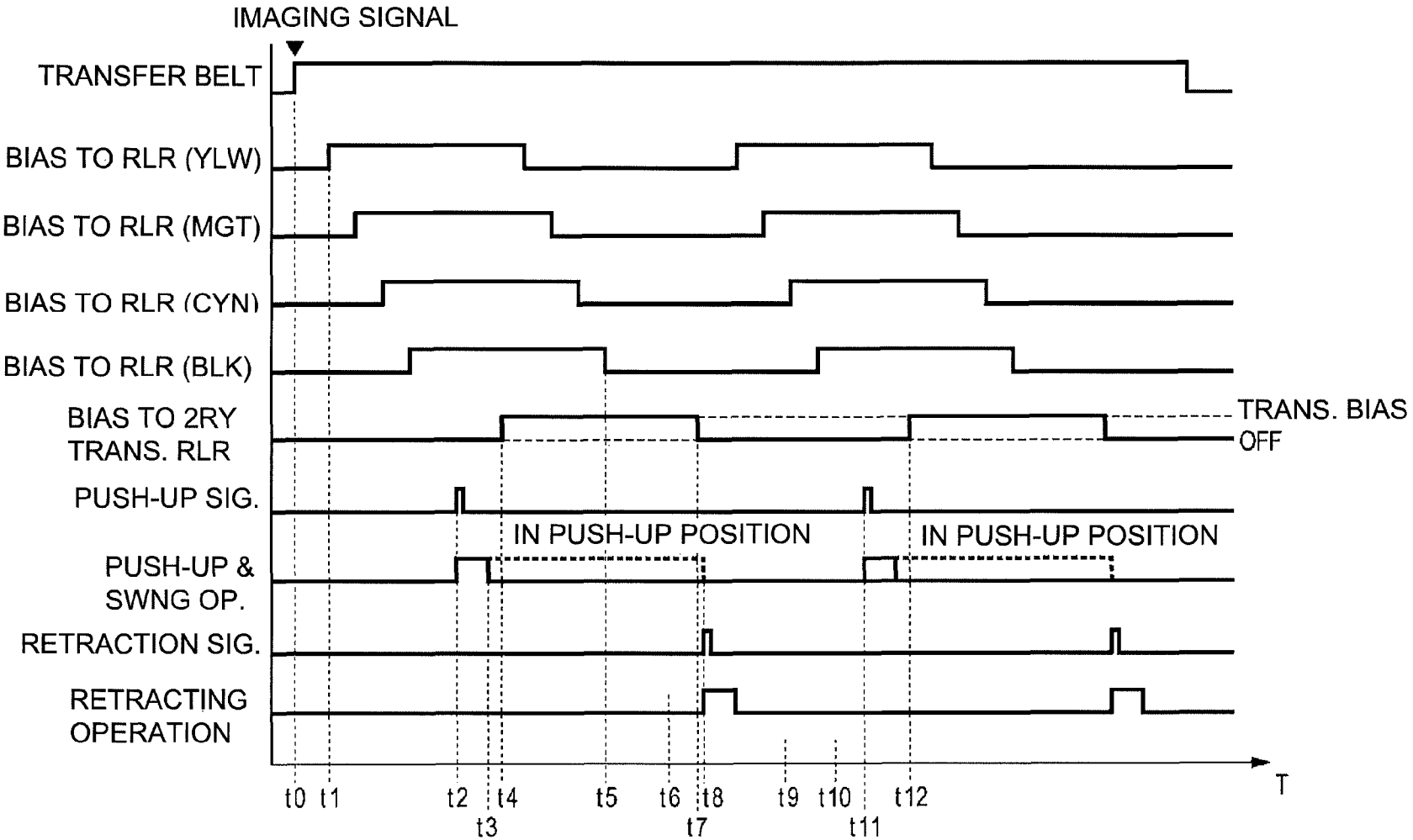

With reference to FIG. 11, the case where the sheets of A3 size which is a size larger than the distance between the fixing device 60 and the projection peak position are continuously conveyed will be described. The rotation of the transfer belt 24 is started on the basis of the image forming signal (t0), and then the toner image transfer (formation) from the photosensitive drum 1Y onto the intermediary transfer belt 6 is started (t1). When the push-up signal is sent to the control circuit 50 (t2) and then the portion operation is completed (t3), the transfer bias is applied to the secondary transfer roller 9 (t4). The push-up operation is completed before the transfer bias is applied to the secondary transfer roller 9 and therefore the toner image formation onto the intermediary transfer belt 6 is not disturbed. Thereafter, the toner image transfer (formation) from the photosensitive drum 1K onto the intermediary transfer belt 6 is completed (t5).

In a period between consecutive image forming operations on the recording materials, the retraction signal for performing the retraction operation for moving the separation assisting roller 41 toward the retraction position is sent to the control circuit 50 after the leading end of the first sheet of the A3-sized paper passes through the separation position (t6) and after the stop of the transfer bias application (t7). This is because a separation property of the first sheet of the recording material from the transfer belt 24 is ensured and the occurrence of the speed fluctuation of the intermediary transfer belt 6 caused due to an instantaneous speed fluctuation of the transfer belt 24 by the retraction operation.

Incidentally, when the fixation of the toner image on the A3-sized paper is effected in the state in which the separation assisting roller 41 is located at the push-up position, there is a possibility that the A3-sized paper creases. Therefore, timing (t8) when the retraction signal is sent is set so that the retraction operation is completed before the leading end of the first sheet of the recording material reaches the entrance of the nip of the fixing device 60 (t9).

In order to separate the recording materials which are continuously conveyed, there is a need to perform the push-up operation again. The push-up signal is, after the trailing end of the first sheet of the recording material passes through the projection peak position (t10), sent to the contact circuit 50 (t11). The portion operation is started after the trailing end of the first sheet of the recording material passes through the projection peak position and thus it is possible to suppress the occurrence of the creases on the first sheet of the recording material, in the fixing device 60, caused due to the push-up operation. Further, the push-up signal sending timing is set so that the push-up operation is completed before the transfer bias for transferring the second sheet of the recording material is applied to the secondary transfer roller 9 (t12). The push-up operation is completed before the transfer bias for transferring the second sheet of the recording material is applied to the secondary transfer roller 9 and thus it is possible to suppress the occurrence of the speed fluctuation of the intermediary transfer belt 6 caused due to the speed fluctuation of the transfer belt 24 by the push-up operation. Incidentally, in this embodiment, in the case where the recording materials are continuously conveyed, the interval between the recording materials is set so that the push-up operation is started after the trailing end of the first sheet of the recording material passes through the projection peak position (t9) and then the transfer bias is applied to the secondary transfer roller 9 after the push-up operation is completed.

In the image forming operation on the final recording material, the retraction signal for moving the separation assisting roller 41 to the retraction position is sent to the control circuit 50 after the application of the transfer bias to the secondary transfer roller 9 is stopped, and thereafter the rotation of the transfer belt is stopped and the image formation is ended.

Incidentally, in this embodiment, the retraction signal sending timing in the image forming operation on the final recording material is after the transfer bias application is stopped but is not limited thereto. The retraction signal sending timing is after the toner image formation on the final recording material is completed and before the transfer bias application is stopped.

In this embodiment, in the case where the retraction operation and the push-up operation are performed between the consecutive image forming operations on the recording materials, the retraction operation is performed before the leading end of the preceding recording material reaches the fixing device 60 and the push-up operation is performed after the trailing end of the preceding recording material passed through the projection peak position. Such control is particularly effective in the case where the fixing device 60 is disposed near to the projection forming portion by placing importance on the downsizing with respect to the recording material conveyance direction and the waviness provided on the recording material at the projection peak position is not sufficiently relaxed in the fixing device 60.

That is, in the image forming apparatus in which the fixing device 60 is disposed near to the projection forming portion by placing importance on the downsizing with respect to the recording material conveyance direction, it is possible to suppress the occurrence of the creases on the recording material in the fixing device 60 caused due to the retraction and push-up operations performed between the consecutive image forming operations on the recording material.

(Embodiment 3): Conveyance Belt Provided with Attraction Mechanism

Figure 12:
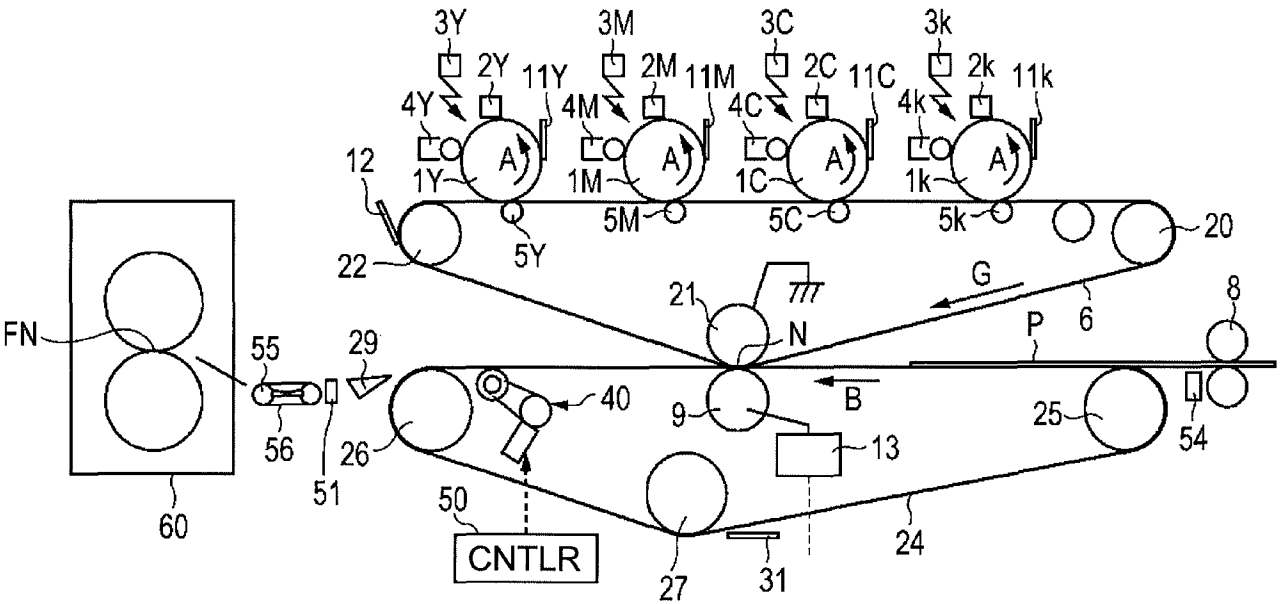
FIGS. 12 and 13 are schematic views for illustrating Embodiment 3.
Figure 13:
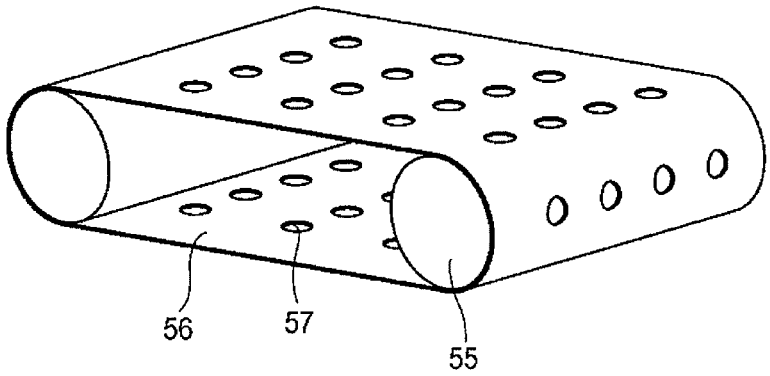

With respect to portions which overlap with those in Embodiment 1, the portions are the same as those in Embodiment 1 and therefore will be omitted from the description. In Embodiment 3, as shown in FIG. 12, a downstream-side conveyance belt 56 which is stretched by a stretching member 55 is disposed downstream of the recording material guide 29 with respect to the recording material conveyance direction. As shown in FIG. 13, the downstream-side conveyance belt 56 is provided with openings 57, and a suction (attraction) mechanism (not shown) for sucking air from the openings 57 to the belt inner surface side is provided. When the recording material reaches the downstream-side conveyance belt 56, the recording material is conveyed while being attracted to the outer surface of the downstream-side conveyance belt 56 by the attraction mechanism, so that the waviness formed on the recording material is relaxed.

Therefore, even when the recording material is conveyed to the fixing device 60 in a state in which the recording material is pushed up by the separation assisting roller 41, the waviness formed on the recording material is relaxed and therefore it is possible to suppress the occurrence of the creases on the recording material in the fixing device 60. There is no need to increase the distance between the projection peak position and the fixing device 60, thus being effective in space saving of the image forming apparatus.

(Embodiment 4)

With respect to portions which overlap with those in Embodiment 1, the portions are the same as those in Embodiment 1 and will be omitted from the description. In Embodiment 4, an adjusting step in which an adjusting voltage for setting the transfer bias as the pre-transfer bias is executed.

In order to set a proper transfer bias (about 3 kV), it is desirable that a correlation between a voltage to be applied to the secondary transfer portion and a current flowing the secondary transfer portion is obtained. Therefore, by applying voltages, as the adjusting voltage, of 2.5 kV, 3 kV and 3.5 kV, current values under application of the respective voltages are measured. On the basis of this measurement result, the transfer bias to be applied to the secondary transfer roller 9 is set.

Figure 14:
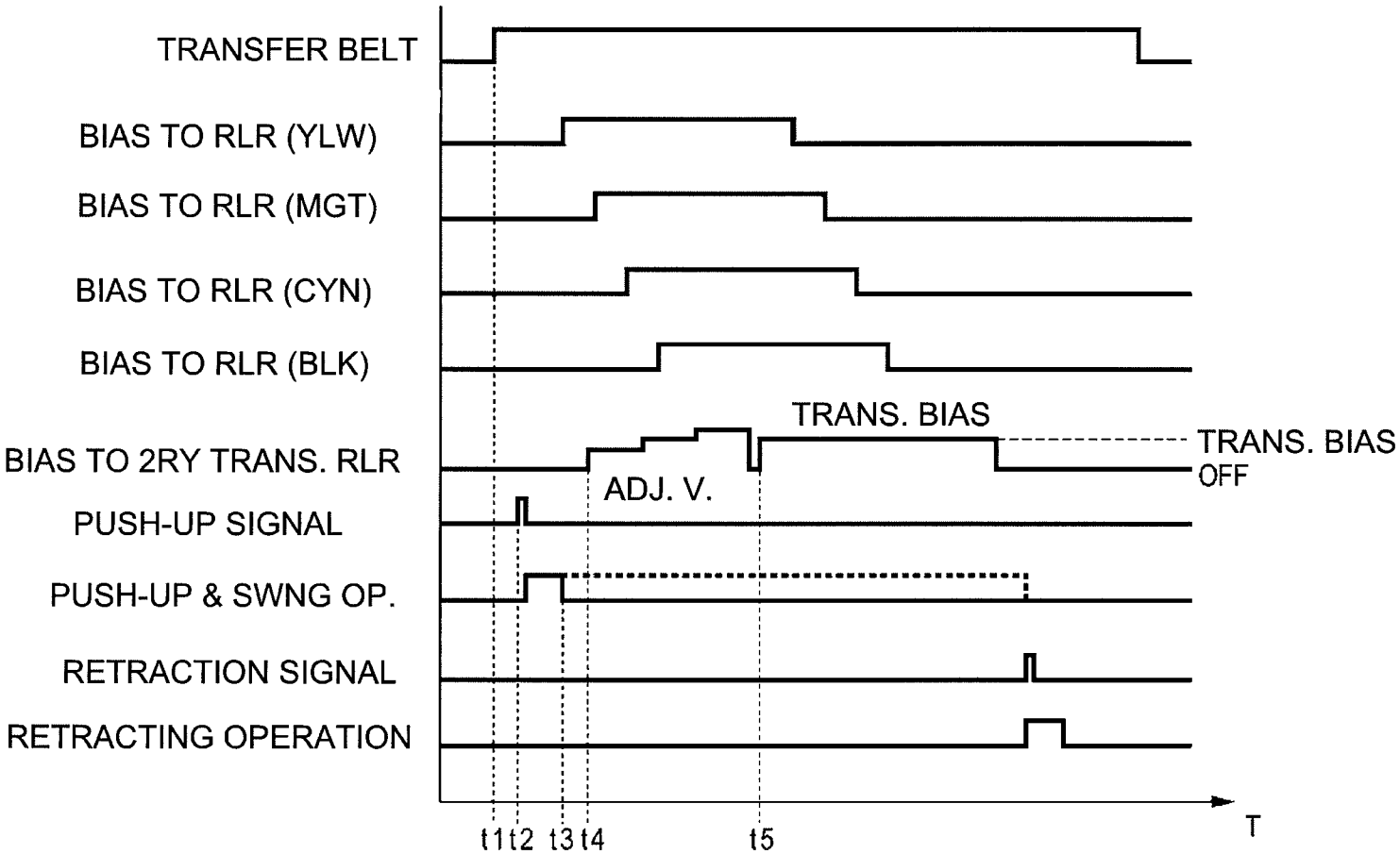
FIG. 14 is a schematic view for illustrating Embodiment 4.

A description will be made with reference to FIG. 14. When the transfer belt is started to be rotated (t1), the push-up operation is performed (t2). Thereafter, when the push-up operation is completed (t3), the adjusting voltage (2.5 kV, 3 kV, 3.5 kV) is applied to the secondary transfer roller 9 (t4). Thereafter, the transfer bias (about 3 kV) is applied to the secondary transfer roller 9 (t5).

That is, in this embodiment, the push-up operation is completed before the adjusting voltage applying step is executed. This reason will be described. The adjusting step may desirably be performed under the same condition as that during the transfer. However, when the push-up operation is performed, a contact state between the intermediary transfer belt 6 and the secondary transfer belt 24 at the secondary transfer portion is changed, so that there is a possibility that impedance of the secondary transfer portion is changed before and after the push-up operation. In the case where the transfer onto the recording material is made in a state in which the separation assisting roller 41 pushes up the transfer belt 24, when the adjusting step is performed in a state in which the separation assisting roller 41 does not push up the transfer belt 24, the transfer and the adjusting step cannot be performed under the same condition.

Therefore, in this embodiment, the push-up operation is completed before the step of applying the adjusting voltage is executed. In the image forming apparatus in which the separation of the recording material is performed by the pushing up, even when the adjusting step for applying the voltage for setting the transfer bias is executed before the transfer bias is applied to the secondary transfer member, it is possible to suppress the influence, on the adjusting step, of the change of the secondary transfer portion by the pushing up.

(Embodiment 5)

(Thick Paper to Thin Paper)

Figure 15:
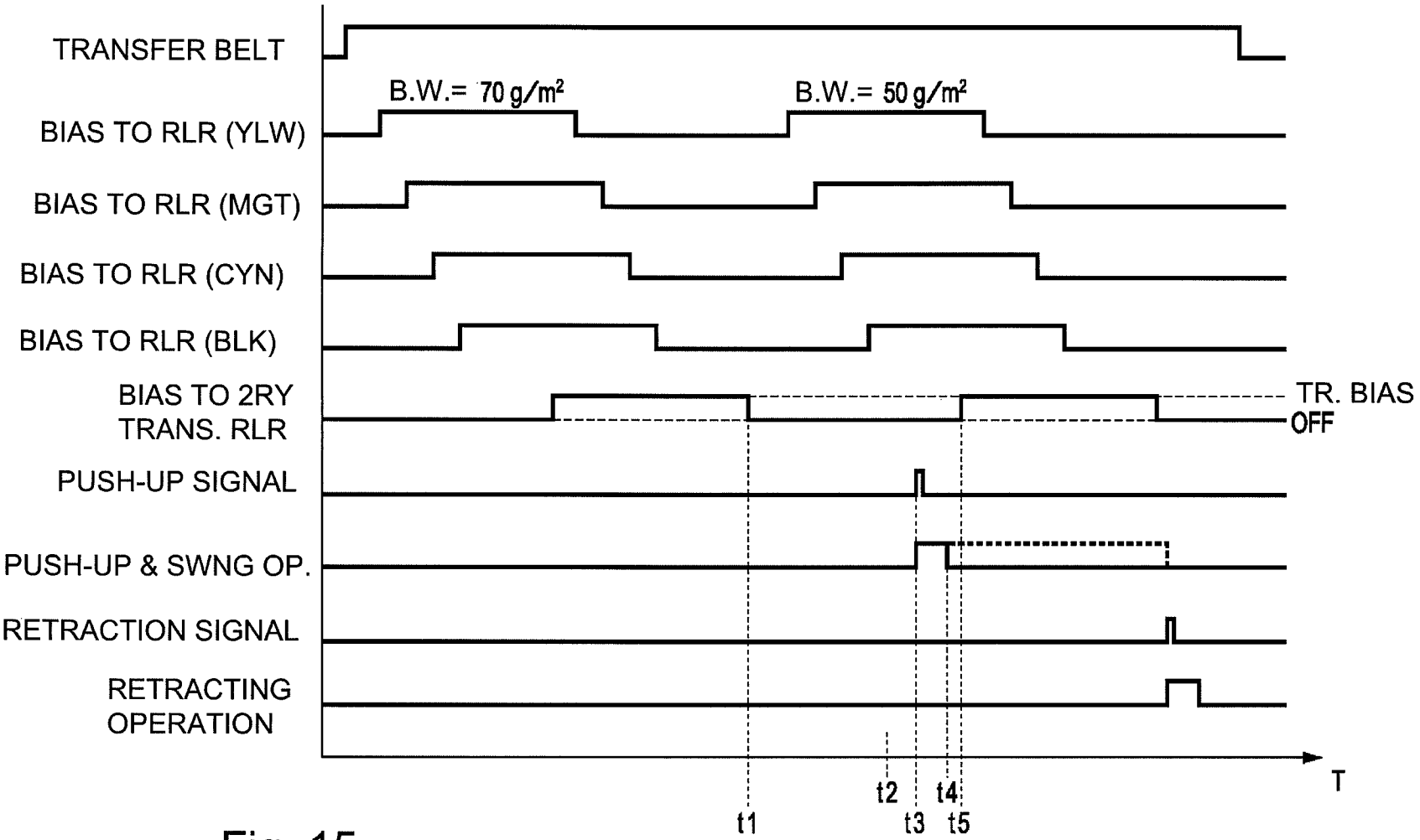
FIGS. 15 and 16 are schematic views for illustrating Embodiment 5.

With reference to FIG. 15, the case where the paper of the A3 size as a size which is larger than the distance between the fixing device 60 and the projection peak position is conveyed will be described. In succession to thick paper having the basis weight of 70 g/m$^2$, thin paper having the basis weight of 50 g/m$^2$ is conveyed. The separation of the thick paper is performed by the separation stretching roller without pushing up the transfer belt 24. On the other hand, the separation of the thin paper is performed by pushing up the transfer belt 24. For that reason, the push-up operation is required to be performed between the image forming operation on the thick paper and the image forming operation on the thin paper. The transfer bias application for the thick paper is stopped (t1) and the trailing end of the thick paper passes through the projection peak position on the transfer belt 24 (t2), and then the push-up signal is sent to the control circuit 50 (t3). Therefore, it is possible to suppress the occurrence of creases on the thick paper in the fixing device by the push-up operation for the thin paper separation. When the push-up operation is completed (t4), the transfer bias is applied to the secondary transfer roller 9 (t5), so that the transfer onto the thin paper is effected. The transfer bias is applied after the completion of the push-up operation and therefore it is possible to reduce a degree of disturbance of the rotational drive by non-uniformity of the rotational speed of the transfer belt 24 caused due to the push-up operation.

(Thin Paper to Thick Paper)

Figure 16:
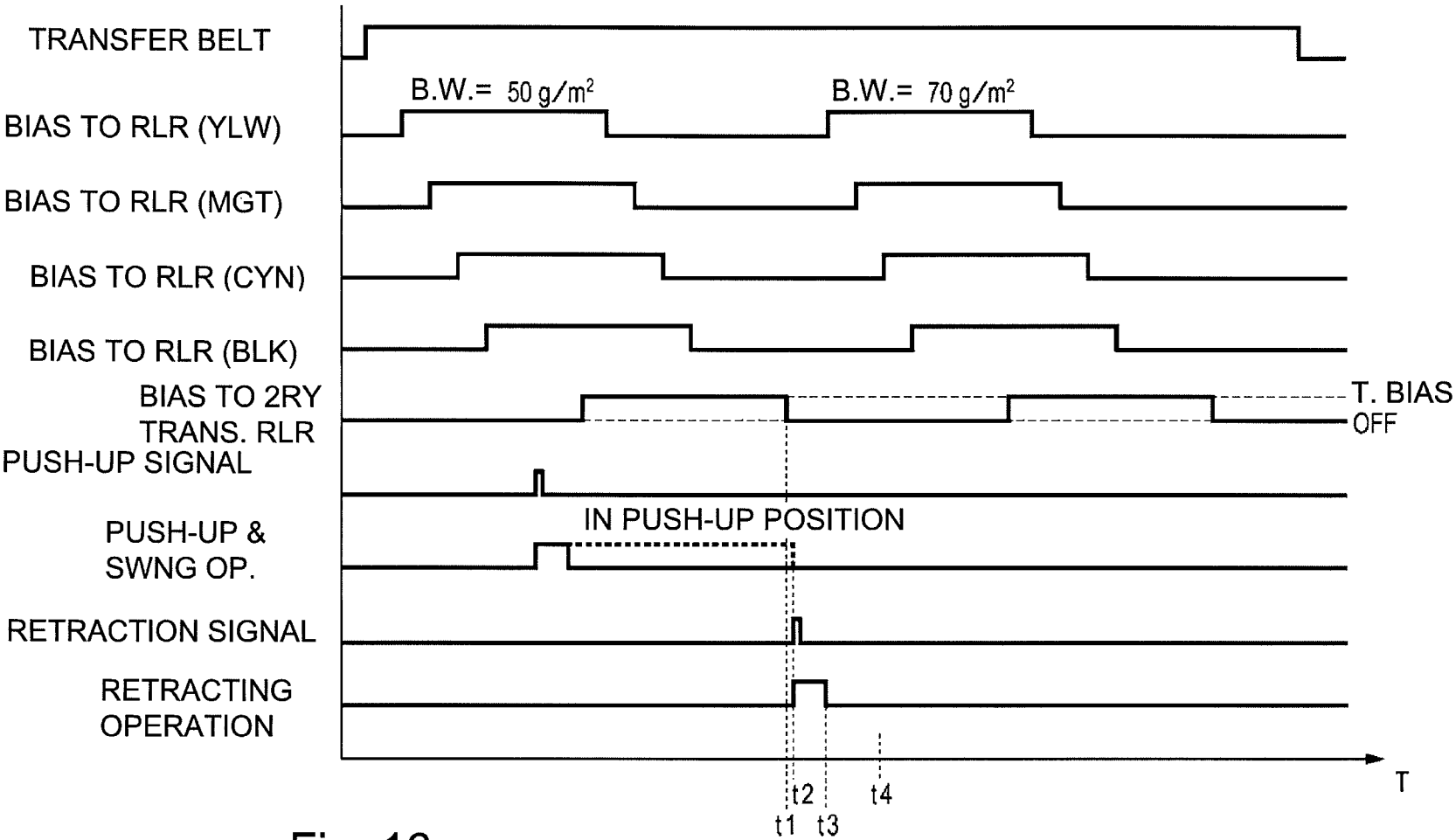

With reference to FIG. 16, the case where the paper of the A3 size as the size which is larger than the distance between the fixing device 60 and the projection peak position is conveyed will be described. In succession to the thin paper having the basis weight of 50 g/m$^2$, the thick paper having the basis weight of 70 g/m$^2$ is conveyed. The separation of the thin paper is performed by the pushing up and the separation of the thick paper is performed by the separation stretching roller, and therefore the retraction operation is performed between the image forming operation for transferring the toner image onto the thin paper and the image forming operation for transferring the toner image onto the thick paper. After the transfer bias application for transferring the toner image onto the thin paper is stopped (t1), the retraction signal is sent to the control circuit 50 (t2). It is possible to suppress the occurrence of the speed fluctuation of the intermediary transfer belt 6 caused due to the speed fluctuation of the transfer belt 24 by the retraction operation. When the retraction operation is completed (t3), the leading end of the thin paper reaches the fixing device 60 (t4). The retraction operation is completed before the thin paper leading end reaches the fixing device, so that it is possible to suppress the occurrence of creases on the thin paper in the fixing device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 125241/2010 filed May 31, 2010, which is hereby incorporated by reference.

What is claimed is:

1. An image forming apparatus comprising:

an image bearing member for bearing a toner image;

toner image forming means for forming a toner image on said image bearing member;

a rotatable belt member, stretched by a plurality of stretching members, for carrying and conveying a recording material;

a transfer member for transferring the toner image from said image bearing member onto the recording material carried on said belt member by pressing said belt member against said image bearing member;

bias applying means for applying to said transfer member a transfer bias for transferring the toner image from said image bearing member onto the recording material;

push-up means for locally pushing up said belt member from an inner surface side of said belt member, in a direction perpendicular to a recording material conveyance direction, at a downstream-side position of said transfer member with respect to the recording material conveyance direction; and an execution portion for executing an operation in a mode in which the recording material is separated from said belt member by a push-up operation for said belt member by said push-up means, wherein in the mode, the push-up operation of said push-up means is performed, during rotation of said belt member, before the transfer bias is applied to said transfer member.

2. An image forming apparatus according to claim 1 wherein when a retracting operation fair retracting said push-up means from a push-up position, in a period between image forming operations on the recording material, during a step in which transfer onto a plurality of sheets of the recording material is effected while continuing the rotation of said belt member, the retracting operation is performed after the application of the transfer bias is stopped.

3. An image forming apparatus according to claim 1, wherein when an adjusting operation in which an adjusting voltage set in advance for setting the transfer bias to be applied to said transfer member is applied to said transfer member is executed, the push-up operation of said push-up means is performed before the adjusting operation is performed.

4. An image forming apparatus according to claim 1, wherein a stretching roller for stretching said belt member is provided downstream of said push-up means with respect to a movement direction of said belt member, and wherein the recording material is separated from said belt member by said stretching roller without performing the push-up operation by said push-up means.

5. An image forming apparatus according to claim 1, wherein said toner image forming means includes a photosensitive drum, and wherein said image bearing member is an intermediary transfer belt for carrying the toner image which has been transferred from the photosensitive drum.

6. An image forming apparatus according to claim 1, further comprising a fixing member provided downstream of a projection peak position on said belt member in which a projection is formed by said push-up means with respect to the recording material conveyance direction, for fixing the toner image on the recording material, and wherein when an image is successively formed on an n-th ($n \geq 1$) sheet of the recording material and an (n+1)-th sheet of the recording material, the push-up operation is performed after a trailing end of the n-th sheet of the recording material passes through the projection peak position on the belt member.

7. An image forming apparatus according to claim 2, further comprising a fixing member provided downstream of a projection peak position on said belt member in which a projection is formed by said push-up means with respect to the recording material conveyance direction, for fixing the toner image on the recording material, and wherein when an image is successively formed on an n-th ($n \geq 1$) sheet of the recording material and an (n+1)-th sheet of the recording material, the retracting operation is performed before a leading end of the n-th sheet of the recording material reaches the fixing member.

* * * * *